US012644630B2

(12) United States Patent
Nishijima et al.

(10) Patent No.: US 12,644,630 B2
(45) Date of Patent: Jun. 2, 2026

(54) HEAT PUMP CYCLE DEVICE

(71) Applicant: DENSO CORPORATION, Kariya-City (JP)

(72) Inventors: Haruyuki Nishijima, Kariya-City (JP); Yuichi Kami, Kariya-City (JP); Hiroshi Mieda, Kariya-City (JP)

(73) Assignee: DENSO CORPORATION, Kariya-city (JP)

( * ) Notice: Subject to any disclaimer, the term of this patent is extended or adjusted under 35 U.S.C. 154(b) by 125 days.

(21) Appl. No.: 18/801,214

(22) Filed: Aug. 12, 2024

(65) Prior Publication Data

US 2024/0401848 A1 Dec. 5, 2024

Related U.S. Application Data

(63) Continuation of application No. PCT/JP2023/003964, filed on Feb. 7, 2023.

(30) Foreign Application Priority Data

Feb. 21, 2022 (JP) ..... 2022-024884

(51) Int. Cl.
*F25B 41/42* (2021.01)
*F25B 30/02* (2006.01)

(52) U.S. Cl.
CPC ..... *F25B 30/02* (2013.01); *F25B 41/42* (2021.01); *F25B 2600/2501* (2013.01); *F25B 2700/21151* (2013.01)

(58) Field of Classification Search
CPC ..... F25B 30/02; F25B 41/42; F25B 2400/04; F25B 2600/026; F25B 2600/0261; F25B 2600/2501; F25B 2700/21151
See application file for complete search history.

(56) References Cited

U.S. PATENT DOCUMENTS 5,167,491 A * 12/1992 Keller, Jr. ..... F04C 28/28 62/196.3
2022/0275982 A1 9/2022 Mieda et al.

FOREIGN PATENT DOCUMENTS

JP 2021156567 A 10/2021

* cited by examiner

*Primary Examiner* — Jonathan Bradford
(74) *Attorney, Agent, or Firm* — Harness, Dickey & Pierce, PLC

(57) ABSTRACT

A heat pump cycle device includes: a compressor; a branch portion; a heating unit configured to heat a heating object using one refrigerant branched at the branch portion as a heat source; a decompression unit configured to decompress the refrigerant flowing out of the heating unit; a bypass passage through which an another refrigerant branched at the branch portion flows; a regulating unit; and a joining portion. When a length of a suction-side flow path from an outlet port of the joining portion to a suction port of the compressor is defined as a suction-side flow path length L1, the suction-side flow path length L1 is equal to or longer than a relaxation distance Lv. The relaxation distance Lv is a flow length that is necessary for the refrigerant mixed in the joining portion to be made in a homogeneous state.

7 Claims, 15 Drawing Sheets

SINGLE HOT-GAS AIR-HEATING MODE

SINGLE HOT-GAS AIR-HEATING MODE

SINGLE HOT-GAS DEHUMIDIFICATION AND AIR-HEATING MODE

SINGLE HOT-GAS DEHUMIDIFICATION AND AIR-HEATING MODE

SINGLE HOT-GAS SERIES
DEHUMIDIFICATION AND AIR-HEATING MODE

SINGLE HOT-GAS SERIES
DEHUMIDIFICATION AND AIR-HEATING MODE

HEAT PUMP CYCLE DEVICE

CROSS REFERENCE TO RELATED APPLICATION

The present application is a continuation application of International Patent Application No. PCT/JP2023/003964 filed on Feb. 7, 2023, which designated the U.S. and claims the benefit of priority from Japanese Patent Application No. 2022-024884 filed on Feb. 21, 2022. The entire disclosures of all of the above applications are incorporated herein by reference.

TECHNICAL FIELD

The present disclosure relates to a heat pump cycle device configured to mix refrigerants with different enthalpies and to suck the mixed refrigerant into a compressor.

BACKGROUND

Conventionally, in a heat pump cycle device applied to a vehicle air conditioner, an operation in a hot-gas air-heating mode is performed using a bypass passage by switching refrigerant circuits in order to heat air to be blown into a vehicle cabin at the time of an extremely low outside air temperature.

SUMMARY

A heat pump cycle device according to an aspect of the present disclosure includes a compressor, a branch portion, a heating unit, a decompression unit, a bypass passage, a regulating unit, and a joining portion.

The compressor is configured to compress and discharge a refrigerant. The branch portion is configured to branch a flow of the refrigerant discharged from the compressor. The heating unit is configured to heat a heating object using one refrigerant branched at the branch portion as a heat source. The decompression unit is configured to decompress the refrigerant flowing out of the heating unit. The bypass passage is provided through which an another refrigerant branched at the branch portion flows. The regulating unit is configured to regulate a flow rate of the refrigerant flowing through the bypass passage. The joining portion is configured to join a flow of a heating-unit side refrigerant flowing out of the decompression unit and a flow of a bypass-side refrigerant flowing out of the regulating unit and to cause a joined refrigerant to flow to a suction port of the compressor.

When a length of a suction-side flow path from an outlet port of the joining portion to the suction port of the compressor is defined as a suction-side flow path length L1, the suction-side flow path length L1 is equal to or longer than a relaxation distance Lv.

The relaxation distance Lv is defined by following Formula 1.

$$Lv = \frac{\rho L \times dp^2}{18\ \mu g} \times Uv \qquad \text{(Formula 1)}$$

In the Formula 1, ρL is a density of droplets that are particles of a liquid-phase refrigerant contained in the refrigerant at a junction MX of the heating-unit side refrigerant and the bypass-side refrigerant in the joining portion, dp is an average diameter of the droplets, μg is a viscosity of a gas-phase refrigerant contained in the refrigerant at the junction MX, and Uv is an average flow velocity of the droplets and the gas-phase refrigerant at the junction MX.

Since the suction-side flow path length L1 is equal to or longer than the relaxation distance Lv, the suction refrigerant sucked into the compressor can be easily made homogeneous.

BRIEF DESCRIPTION OF DRAWINGS

The foregoing and other objects, features, and advantages of the present disclosure will become more apparent from the following detailed description with reference to the accompanying drawings. In the drawings.

DESCRIPTION OF EMBODIMENTS

Figure 1:
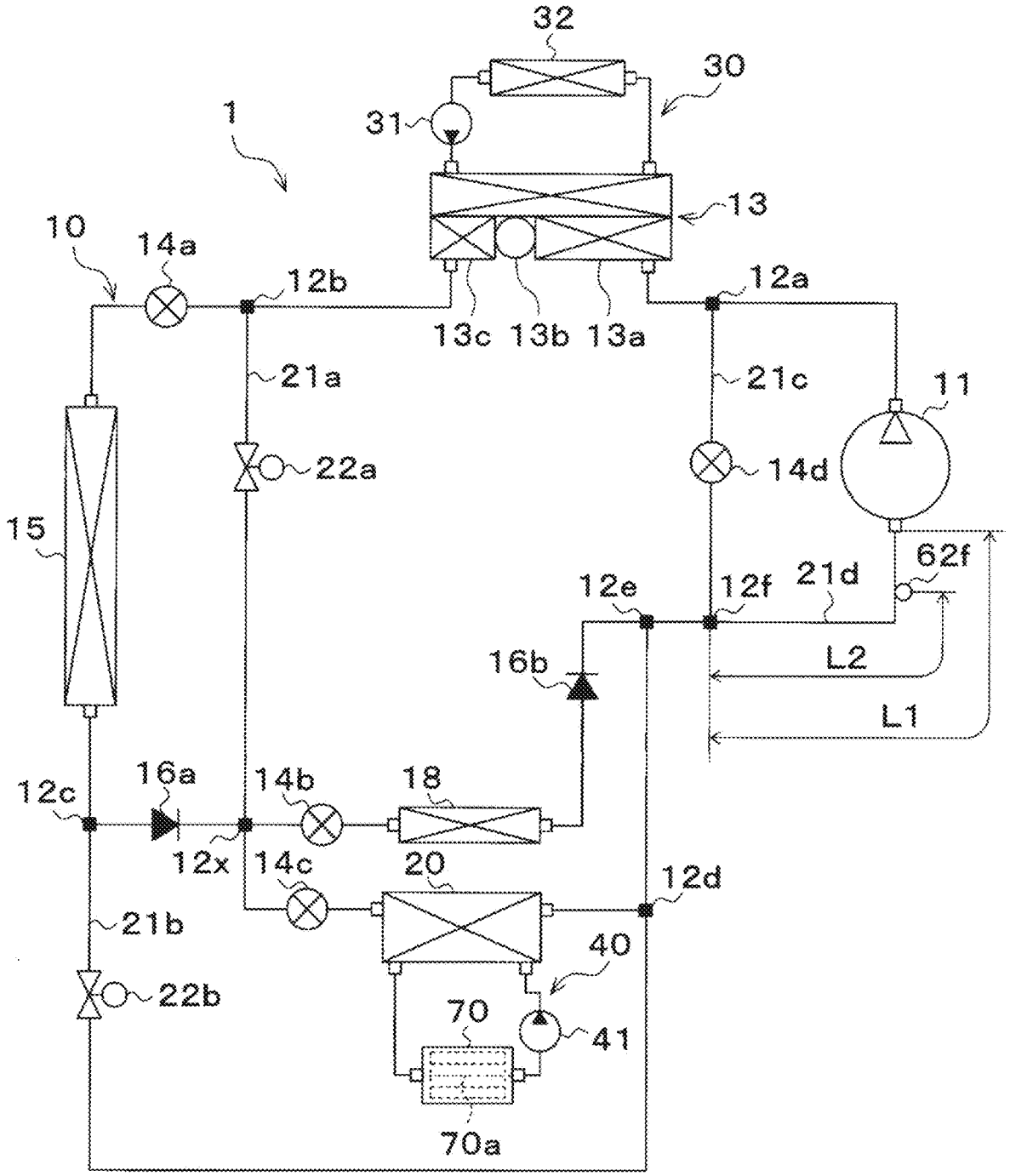
FIG. 1 is a schematic overall configuration diagram of a vehicle air conditioner of a first embodiment.

In a refrigerant circuit of a hot-gas air-heating mode of a heat pump cycle of a comparative example, a flow of a discharge refrigerant discharged from a compressor is branched at a branch portion, and one branched refrigerant is caused to flow into a heating unit. The heating unit heats ventilation air by heat exchange between the refrigerant and the ventilation air to be blown into a vehicle cabin. Furthermore, the refrigerant flowing out of the heating unit is decompressed by a heating-unit side decompression unit. The other refrigerant branched at the branch portion is caused to flow into a bypass passage. Furthermore, the refrigerant flowing into the bypass passage is decompressed by a bypass-side flow-rate regulating valve.

The gas-liquid two-phase refrigerant with a low enthalpy decompressed by the heating-unit side decompression unit, and the gas-phase refrigerant with a relatively high enthalpy decompressed by the bypass-side flow-rate regulating valve are mixed by a mixing unit and sucked into the compressor. That is, in the heat pump cycle device of the comparative example, at the time of the hot-gas air-heating mode, the refrigerant circuit is switched to a refrigerant circuit in which refrigerants with different enthalpies are mixed in the mixing unit and sucked into the compressor.

In addition, the heat pump cycle device of the comparative example is provided with a mixing unit that mixes refrigerants with different enthalpies so as to be in a homogeneous state. As a result, in the heat pump cycle device of Patent Literature 1, liquid compression of the compressor in the hot-gas air-heating mode is restricted to protect the compressor.

However, when the mixing unit is used in the heat pump cycle device of the comparative example, the size of the entire heat pump cycle device is likely to increase, and mountability of the heat pump cycle device is likely to be degraded. As a result, the productivity of the heat pump cycle device deteriorates.

In view of the above, an object of the present disclosure is to provide a heat pump cycle device that is configured to mix refrigerants with different enthalpies and to suck the mixed refrigerant into a compressor, and to be capable of protecting the compressor and preventing deterioration in productivity.

A heat pump cycle device according to an aspect of the present disclosure includes a compressor, a branch portion, a heating unit, a decompression unit, a bypass passage, a regulating unit, and a joining portion.

The compressor is configured to compress and discharge a refrigerant. The branch portion is configured to branch a flow of the refrigerant discharged from the compressor. The heating unit is configured to heat a heating object using one refrigerant branched at the branch portion as a heat source. The decompression unit is configured to decompress the refrigerant flowing out of the heating unit. The bypass passage is provided through which an another refrigerant branched at the branch portion flows. The regulating unit is configured to regulate a flow rate of the refrigerant flowing through the bypass passage. The joining portion is configured to join a flow of a heating-unit side refrigerant flowing out of the decompression unit and a flow of a bypass-side refrigerant flowing out of the regulating unit and to cause a joined refrigerant to flow to a suction port of the compressor.

When a length of a suction-side flow path from an outlet port of the joining portion to the suction port of the compressor is defined as a suction-side flow path length L1, the suction-side flow path length L1 is equal to or longer than a relaxation distance Lv.

The relaxation distance Lv is defined by following Formula 1.

$$Lv = \frac{\rho L \times dp^2}{18\ \mu g} \times Uv \qquad \text{(Formula 1)}$$

In the Formula 1, ρL is a density of droplets that are particles of a liquid-phase refrigerant contained in the refrigerant at a junction MX of the heating-unit side refrigerant and the bypass-side refrigerant in the joining portion, dp is an average diameter of the droplets, μg is a viscosity of a gas-phase refrigerant contained in the refrigerant at the junction MX, and Uv is an average flow velocity of the droplets and the gas-phase refrigerant at the junction MX.

According to this, since the suction-side flow path length L1 is equal to or longer than the relaxation distance Lv, the suction refrigerant sucked into the compressor can be made homogeneous, as will be described later in embodiments. Therefore, uneven distribution of the liquid-phase refrigerant in the suction refrigerant can be prevented, and the compressor can be protected.

The suction-side flow path length L1 can be easily regulated by changing the length of a refrigerant pipe connecting the outlet port of the joining portion and the suction port of the compressor. Therefore, the productivity of the heat pump cycle device is less likely to deteriorate in order to make the suction refrigerant homogeneous.

As a result, according to the heat pump cycle device of the aspect of the present disclosure, even in a heat pump cycle device that mixes refrigerants with different enthalpies and sucks the mixed refrigerant into a compressor, it is possible to protect the compressor and prevent deterioration in productivity.

Here, the refrigerant in a homogeneous state can be defined as a refrigerant whose temperature and velocity have reached an equilibrium state and whose temperature distribution and velocity distribution have been sufficiently suppressed. In a case where the homogeneous state of the refrigerant joined at the joining portion is a gas-liquid two-phase refrigerant, the refrigerant can be defined as a refrigerant in which droplets contained in the refrigerant are uniformly distributed in the gas-phase refrigerant, and the temperature distribution and velocity distribution are sufficiently suppressed between the droplets and the gas-phase refrigerant.

A plurality of embodiments for carrying out the present disclosure will be described below with reference to the drawings. In each embodiment, parts corresponding to matters described in the preceding embodiment are denoted by the same reference numerals, and redundant description may be omitted. In a case where only a part of the configuration is described in each embodiment, other embodiments described above can be used for other parts of the configuration. It is possible not only to combine parts that can be explicitly combined in the embodiments, but also to partially combine the embodiments even if not explicitly specified if there is no trouble with the combination.

First Embodiment

A first embodiment of a heat pump cycle device according to the present disclosure will be described with reference to FIGS. 1 to 13. In the present embodiment, the heat pump cycle device according to the present disclosure is applied to a vehicle air conditioner 1 mounted on an electric vehicle. The electric vehicle is a vehicle that obtains driving force for traveling from an electric motor. The vehicle air conditioner 1 performs air conditioning in a vehicle cabin that is a space to be air conditioned, and also regulates the temperature of an in-vehicle device. Therefore, the vehicle air conditioner 1 can be referred to as an air conditioner with an in-vehicle device temperature regulation function or an in-vehicle device temperature regulation device with an air conditioning function.

Specifically, the vehicle air conditioner 1 regulates the temperature of a battery 70 as an in-vehicle device. The battery 70 is a secondary battery that stores electric power supplied to a plurality of in-vehicle devices operated by electricity. The battery 70 is an assembled battery formed by electrically connecting a plurality of battery cells arranged in a stacked manner in series or in parallel. The battery cell of the present embodiment is a lithium ion battery.

The battery 70 generates heat during operation (that is, at the time of charging and discharging). The output of the battery 70 is likely to decrease at a low temperature, and the battery is likely to deteriorate at a high temperature. Therefore, the temperature of the battery 70 needs to be maintained within an appropriate temperature range (in the present embodiment, equal to or higher than 15° C. and equal to or lower than 55° C.). Therefore, in the electric vehicle of the present embodiment, the temperature of the battery 70 is regulated using the vehicle air conditioner 1. It is needless to mention that the in-vehicle device whose temperature is to be regulated by the vehicle air conditioner 1 is not limited to the battery 70.

The vehicle air conditioner 1 includes a heat pump cycle 10, a high-temperature side heat medium circuit 30, a low-temperature side heat medium circuit 40, an interior air conditioning unit 50, a control device 60, and the like.

First, the heat pump cycle 10 will be described with reference to FIG. 1. The heat pump cycle 10 is a vapor compression refrigeration cycle that regulates the temperature of ventilation air supplied into the vehicle cabin, a high-temperature side heat medium circulating in the high-temperature side heat medium circuit 30, and a low-temperature side heat medium circulating in the low-temperature side heat medium circuit 40.

The heat pump cycle 10 is configured to be able to switch a refrigerant circuit based on various operation modes to be described later in order to perform air conditioning in the vehicle cabin and temperature regulation of the in-vehicle device. The heat pump cycle 10 uses, as a refrigerant, an HFO refrigerant (specifically, R1234yf). The heat pump cycle 10 configures a subcritical refrigeration cycle in which the refrigerant pressure on a high pressure side does not exceed the critical pressure of the refrigerant.

Refrigerant oil for lubricating a compressor 11 is mixed with the refrigerant. The refrigerant oil is a PAG oil (that is, polyalkylene glycol oil) compatible with a liquid-phase refrigerant or POE (that is, polyol ester). A part of the refrigerant oil circulates in the heat pump cycle 10 together with the refrigerant.

The compressor 11 sucks, compresses, and discharges the refrigerant in the heat pump cycle 10. The compressor 11 is an electric compressor in which a fixed capacity type compression mechanism with a fixed discharge capacity is rotationally driven by an electric motor. The refrigerant discharge performance (that is, the rotation speed) of the compressor 11 is controlled by a control signal output from the control device 60 to be described later.

The compressor 11 is disposed in a drive unit chamber formed on the front side of the vehicle cabin. The drive unit chamber forms a space in which at least a part of a device (for example, a motor generator as a traveling electric motor) used for generating or regulating driving force for vehicle traveling is disposed.

An inlet port side of a first three-way joint 12*a* is connected to a discharge port of the compressor 11. The first three-way joint 12*a* has three inlet and outlet ports communicating with each other. As the first three-way joint 12*a*, a joint formed by joining a plurality of pipes or a joint formed by providing a plurality of refrigerant passages in a metal block or a resin block can be used.

As described later, the heat pump cycle 10 further includes a second three-way joint 12*b* to a sixth three-way joint 12*f*. The basic configurations of the second three-way joint 12*b* to the sixth three-way joint 12*f* are similar to that of the first three-way joint 12*a*. The basic configuration of each three-way joint described in the embodiments to be described later is also similar to that of the first three-way joint 12*a*.

In these three-way joints, when one of the three inlet and outlet ports is used as an inlet port and the remaining two are used as outlet ports, the flow of the refrigerant is branched. When two of the three inlet and outlet ports are used as the inlet ports and the remaining one is used as the outlet port, the flows of the refrigerant are joined. The first three-way joint 12*a* is a branch portion that branches the flow of the discharge refrigerant discharged from the compressor 11.

An inlet port side of a refrigerant passage in a water-refrigerant heat exchanger 13 is connected to one outlet port of the first three-way joint 12*a*. One inlet port side of the sixth three-way joint 12*f* is connected to the other outlet port of the first three-way joint 12*a*.

The refrigerant passage from the other outlet port of the first three-way joint 12*a* to one inlet port of the sixth three-way joint 12*f* is a bypass passage 21*c*. A bypass-side flow-rate regulating valve 14*d* is disposed in the bypass passage 21*c*.

The bypass-side flow-rate regulating valve 14*d* is a bypass-passage side decompression unit that decompresses the discharge refrigerant (that is, the other discharge refrigerant branched at the first three-way joint 12*a*) flowing out of the other outlet port of the first three-way joint 12*a* in a hot-gas air-heating mode or the like to be described later. The bypass-side flow-rate regulating valve 14*d* is a bypass-side flow-rate regulating unit that regulates the flow rate (the mass flow rate) of the refrigerant flowing through the bypass passage 21*c*.

The bypass-side flow-rate regulating valve 14*d* is an electric variable throttle mechanism including a valve body that changes the throttle opening and an electric actuator (specifically, a stepping motor) as a drive unit that displaces the valve body. The operation of the bypass-side flow-rate regulating valve 14*d* is controlled by a control pulse output from the control device 60.

The bypass-side flow-rate regulating valve 14*d* has a full-open function of functioning as a simple refrigerant passage without exhibiting a refrigerant decompression action and a flow-rate regulating action by setting the throttle opening in a fully open state. The bypass-side flow-rate regulating valve 14*d* has a full-close function of closing the refrigerant passage by setting the throttle opening in a fully closed state.

The heat pump cycle 10 further includes an air-heating expansion valve 14*a*, an air-cooling expansion valve 14*b*, and a cooling expansion valve 14*c* as described later. The basic configurations of the air-heating expansion valve 14*a*, the air-cooling expansion valve 14*b*, and the cooling expansion valve 14*c* are similar to that of the bypass-side flow-rate regulating valve 14*d*.

The air-heating expansion valve 14*a*, the air-cooling expansion valve 14*b*, the cooling expansion valve 14*c*, and the bypass-side flow-rate regulating valve 14*d* can switch the refrigerant circuit by exhibiting the full-close function. Therefore, the air-heating expansion valve 14*a*, the air-cooling expansion valve 14*b*, the cooling expansion valve 14*c*, and the bypass-side flow-rate regulating valve 14*d* also function as a refrigerant circuit switching unit.

It is needless to mention that the air-heating expansion valve 14*a*, the air-cooling expansion valve 14*b*, the cooling expansion valve 14*c*, and the bypass-side flow-rate regulating valve 14*d* may be formed by combining a variable throttle mechanism that does not have a full-close function and an on-off valve that opens and closes a throttle passage. In this case, each on-off valve serves as a refrigerant circuit switching unit.

The water-refrigerant heat exchanger 13 is a heat-radiating heat exchange unit that exchanges heat between the high-pressure refrigerant discharged from the compressor 11 and the high-temperature side heat medium circulating in the high-temperature side heat medium circuit 30 to radiate heat of the high-pressure refrigerant to the high-temperature side heat medium. In the present embodiment, a so-called subcool heat exchanger is used as the water-refrigerant heat exchanger 13. For this reason, a condensing portion 13*a*, a receiver 13*b*, and a subcooling portion 13*c* are arranged in the refrigerant passage of the water-refrigerant heat exchanger 13.

The condensing portion 13*a* is a condensing heat exchange unit that exchanges heat between the high-pressure refrigerant discharged from the compressor 11 and the high-pressure side heat medium to condense the high-pressure refrigerant. The receiver 13*b* is a high-pressure side gas-liquid separating unit that separates the refrigerant flowing out of the condensing portion 13*a* into gas and liquid and stores the separated liquid-phase refrigerant as an excess refrigerant in the cycle. The subcooling portion 13*c* is a subcooling heat exchange unit that exchanges heat between the liquid-phase refrigerant flowing out of the receiver 13*b* and the high-pressure side heat medium to subcool the liquid-phase refrigerant.

An inlet port side of the second three-way joint 12*b* is connected to an outlet port of the refrigerant passage in the water-refrigerant heat exchanger 13 (specifically, outlet port of the subcooling portion 13*c*). An inlet port side of the air-heating expansion valve 14*a* is connected to one outlet port of the second three-way joint 12*b*. One inlet port side of a four-way joint 12*x* is connected to the other outlet port of the second three-way joint 12*b*.

The refrigerant passage from the other outlet port of the second three-way joint 12*b* to one inlet port of the four-way joint 12*x* is a dehumidifying passage 21*a*. A dehumidifying on-off valve 22*a* is disposed in the dehumidifying passage 21*a*.

The dehumidifying on-off valve 22*a* is an on-off valve that opens and closes the dehumidifying passage 21*a*. The dehumidifying on-off valve 22*a* is an electromagnetic valve whose opening and closing operation is controlled by a control voltage output from the control device 60. The dehumidifying on-off valve 22*a* can switch the refrigerant circuit by opening and closing the dehumidifying passage 21*a*. Therefore, the dehumidifying on-off valve 22*a* is a refrigerant circuit switching unit.

The four-way joint 12*x* is a joint having four inlet and outlet ports communicating with each other. As the four-way joint 12*x*, a joint formed in a similar manner to the three-way joint can be used. As the four-way joint 12*x*, a joint formed by combining two three-way joints may be used.

The air-heating expansion valve 14*a* is a decompression unit on the outside heat exchanger side that decompresses the refrigerant flowing into an outside heat exchanger 15 in an air-heating mode or the like to be described later. The air-heating expansion valve 14*a* is also a flow-rate regulating unit on the outside heat exchanger side that regulates the flow rate (the mass flow rate) of the refrigerant flowing into the outside heat exchanger 15.

A refrigerant inlet port side of the outside heat exchanger 15 is connected to an outlet port of the air-heating expansion valve 14*a*. The outside heat exchanger 15 is an outside air heat exchange unit that exchanges heat between the refrigerant flowing out of the air-heating expansion valve 14*a* and outside air supplied by an outside air fan (not illustrated). The outside heat exchanger 15 is disposed on the front side of the drive unit chamber. As a result, during traveling of the vehicle, traveling air flowing into the drive unit chamber through a grill can be applied to the outside heat exchanger 15.

An inlet port side of the third three-way joint 12*c* is connected to a refrigerant outlet port of the outside heat exchanger 15. Another inlet port side of the four-way joint 12*x* is connected to one outlet port of the third three-way joint 12*c* via a first check valve 16*a*. One inlet port side of the fourth three-way joint 12*d* is connected to the other outlet port of the third three-way joint 12*c*.

The refrigerant passage from the other outlet port of the third three-way joint 12*c* to one inlet port of the fourth three-way joint 12*d* is an air-heating passage 21*b*. An air-heating on-off valve 22*b* is disposed in the air-heating passage 21*b*.

The air-heating on-off valve 22*b* is an on-off valve that opens and closes the air-heating passage 21*b*. The basic configuration of the air-heating on-off valve 22*b* is similar to that of the dehumidifying on-off valve 22*a*. Therefore, the air-heating on-off valve 22*b* is a refrigerant circuit switching unit. The basic configuration of each on-off valve described in the embodiments to be described later is also similar to that of the dehumidifying on-off valve 22*a*.

The first check valve 16*a* allows the refrigerant to flow from the third three-way joint 12*c* side to the four-way joint 12*x* side, and prohibits the refrigerant from flowing from the four-way joint 12*x* side to the third three-way joint 12*c* side.

A refrigerant inlet port side of an inside evaporator 18 is connected to one outlet port of the four-way joint 12*x* via the air-cooling expansion valve 14*b*.

The air-cooling expansion valve 14*b* is a decompression unit on the inside evaporator side that decompresses the refrigerant flowing into the inside evaporator 18 in an air-cooling mode, a hot-gas dehumidification and air-heating mode, or the like to be described later. Therefore, the air-cooling expansion valve 14*b* serves as a heating-unit side decompression unit in the hot-gas dehumidification and air-heating mode or the like. The air-cooling expansion valve 14*b* is also a flow-rate regulating unit on the inside evaporator side that regulates the flow rate (the mass flow rate) of the refrigerant flowing into the inside evaporator 18.

The inside evaporator 18 is disposed in an air conditioning casing 51 of the interior air conditioning unit 50 to be described later. The inside evaporator 18 is an air-cooling heat exchange unit that exchanges heat between the low-pressure refrigerant decompressed by the air-cooling expansion valve 14*b* and the ventilation air supplied by an inside blower 52 toward the vehicle cabin. The inside evaporator 18 cools the ventilation air by evaporating the low-pressure refrigerant and exhibiting a heat absorbing action.

One inlet port side of the fifth three-way joint 12*e* is connected to a refrigerant outlet port of the inside evaporator 18 via a second check valve 16*b*. The second check valve 16*b* allows the refrigerant to flow from the refrigerant outlet port side of the inside evaporator 18 to the fifth three-way joint 12*e* side, and prohibits the refrigerant from flowing from the fifth three-way joint 12*e* side to the refrigerant outlet port side of the inside evaporator 18.

An inlet port side of a refrigerant passage in a chiller 20 is connected to another outlet port of the four-way joint 12*x* via the cooling expansion valve 14*c*.

The cooling expansion valve 14*c* is a chiller-side decompression unit that decompresses the refrigerant flowing into the chiller 20 in a cooling and air-cooling mode, the hot-gas air-heating mode, or the like to be described later. Therefore, the cooling expansion valve 14*c* serves as a heating-unit side decompression unit in the hot-gas air-heating mode or the like. The cooling expansion valve 14*c* is also a chiller-side flow-rate regulating unit that regulates the flow rate (the mass flow rate) of the refrigerant flowing into the chiller 20.

The chiller 20 is a temperature-regulating heat exchange unit that exchanges heat between the low-pressure refrigerant decompressed by the cooling expansion valve 14*c* and the low-temperature side heat medium circulating in the low-temperature side heat medium circuit 40. The chiller 20 cools the low-temperature side heat medium by evaporating the low-pressure refrigerant and exhibiting the heat absorbing action.

The other inlet port side of the fourth three-way joint 12*d* is connected to an outlet port of the refrigerant passage in the chiller 20. The other inlet port side of the fifth three-way joint 12*e* is connected to an outlet port of the fourth three-way joint 12*d*. The other inlet port side of the sixth three-way joint 12*f* is connected to an outlet port of the fifth three-way joint 12*e*. A suction port side of the compressor 11 is connected to an outlet port of the sixth three-way joint 12*f*.

Accordingly, in the hot-gas air-heating mode or the like, the sixth three-way joint 12*f* serves as a joining portion that joins the flow of the heating-unit side refrigerant flowing out of the heating-unit side decompression unit and the flow of the bypass-side refrigerant flowing out of the bypass-side flow-rate regulating valve 14*d*, and causes the joined flow to flow to the suction port side of the compressor 11.

Figure 2:
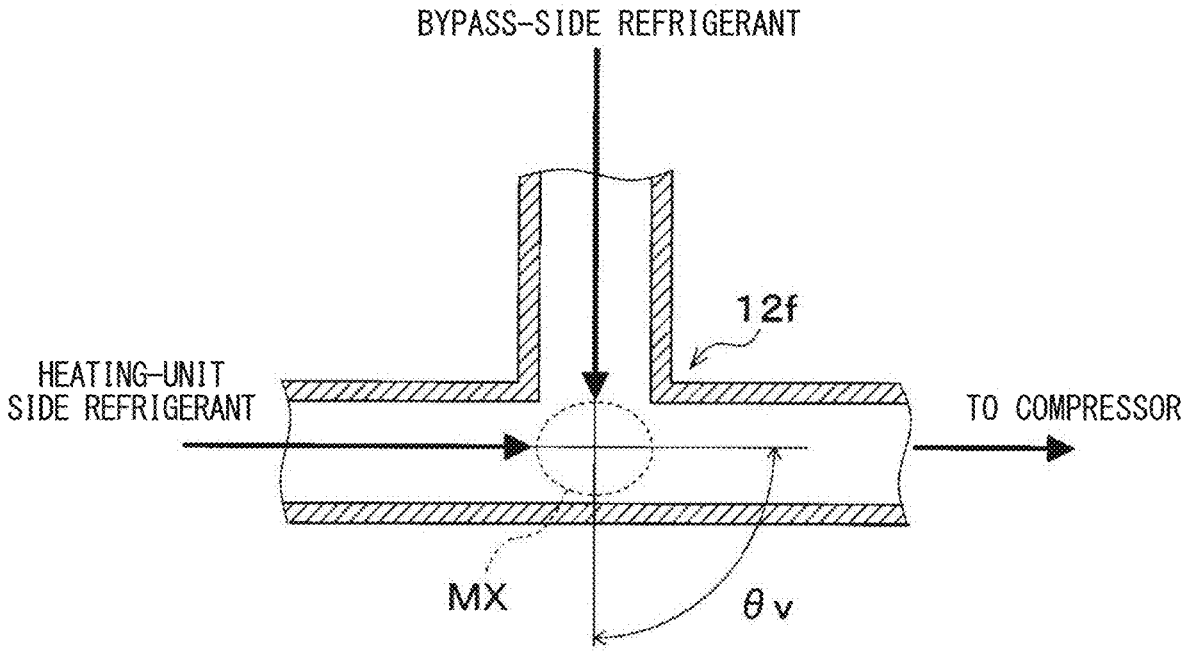
FIG. 2 is a schematic sectional view showing a joining portion of the first embodiment.

As illustrated in the sectional view of FIG. 2, the refrigerant passage in the sixth three-way joint 12*f* of the present embodiment is formed in a manner that the flow direction of the main flow of the heating-unit side refrigerant immediately before joining and the flow direction of the main flow of the bypass-side refrigerant immediately before joining cross each other. More specifically, the refrigerant passage in the sixth three-way joint 12*f* of the present embodiment is formed in a manner that the joining angle θv, which is an angle formed by the flow direction of the main flow of the heating-unit side refrigerant and the flow direction of the main flow of the bypass-side refrigerant, is about 90°.

The refrigerant passage from the outlet port of the sixth three-way joint 12*f* to the suction port of the compressor 11 is a suction-side passage 21*d* forming a suction-side flow path. In the present embodiment, when the length of the suction-side passage 21*d* is defined as a suction-side flow path length L1, the suction-side flow path length L1 is equal to or longer than a relaxation distance Lv.

The suction-side flow path length L1 can be defined by the length of the center line of the pipe forming the suction-side passage 21*d*. In a case where the suction-side passage 21*d* is curved, the length can be defined by the length of the center line connecting the center points (centers of gravity) in cross-sections perpendicular to the refrigerant flow direction of the refrigerant pipe forming the suction-side passage 21*d*.

The relaxation distance Lv is a flow path length necessary for mixing a gas-liquid two-phase refrigerant with relatively low enthalpy and a gas-phase refrigerant with relatively high enthalpy at the sixth three-way joint 12*f*, which is a joining portion, and eliminating the non-equilibrium state of the mixed refrigerant. That is, the relaxation distance Lv is a flow path length necessary for bringing the refrigerant mixed at the joining portion into a homogeneous state.

Here, the refrigerant in the homogeneous state can be defined as a refrigerant whose temperature and velocity have reached an equilibrium state and whose temperature distribution and velocity distribution have been sufficiently suppressed.

In a case where the homogeneous state of the refrigerant joined at the sixth three-way joint 12*f* is the gas-liquid two-phase refrigerant, the refrigerant can be defined as a refrigerant in which droplets, which are particles of the liquid-phase refrigerant contained in the refrigerant, are uniformly distributed in the gas-phase refrigerant, and the temperature distribution and velocity distribution are sufficiently suppressed between the droplets and the gas-phase refrigerant.

The relaxation distance Lv is defined by the following Formula F1.

[Mathematical 2]

$$Lv = \tau v \times Uv \tag{F1}$$

τv is a velocity relaxation time. Uv is the average flow velocity of the droplets and the gas-phase refrigerant at a junction MX of the heating-unit side refrigerant and the bypass-side refrigerant in the sixth three-way joint 12*f*.

In order to determine the relaxation distance Lv, it is necessary to examine the velocity equilibrium and temperature equilibrium between the droplets and the gas-phase refrigerant at the junction MX. The is because, even in a case the equilibrium state of the joined refrigerant is the gas-phase refrigerant, the droplets and the gas-phase refrigerant are present at the junction MX.

First, the velocity equilibrium between the droplets and the gas-phase refrigerant will be examined. The equation of motion for the resistance force acting on the droplets at the junction MX can be expressed by Formula F2 using the Stokes resistance equation.

[Mathematical 3]

$$m\frac{dUL}{dt} = 3\pi \times \mu g \times dp\,(Ug - UL) \tag{F2}$$

m is the average mass of the droplets at the junction MX. UL is the average velocity of the droplets at the junction MX. Ug is the average velocity of the gas-phase refrigerant at the junction MX. μg is the viscosity of the gas-phase refrigerant at the junction MX. dp is the average diameter of the droplets at the junction MX.

Furthermore, as shown in Formula F3, the velocity relaxation time τv is defined.

[Mathematical 4]

$$\tau v = \frac{m}{3\pi \times \mu g \times dp} \quad \text{(F3)}$$

As a result, Formula F2 can be transformed as shown in Formula F4.

[Mathematical 5]

$$\frac{dUL}{dt} = \frac{Ug - UL}{\tau v} \quad \text{(F4)}$$

Since the average velocity UL of the droplets and the average velocity Ug of the gas-phase refrigerant finally converge to the same value, the velocity relaxation time τv in the above Formula F3 is a parameter representing followability with respect to the fluid motion of the droplets. When the above Formula F4 is solved with the average velocity Ug as a constant value and the average velocity of the droplets at the time t=0 as a constant value UL0, the time required for the average velocity UL of the droplets to relax to the average velocity Ug of the gas-phase refrigerant can be calculated.

Figure 3:
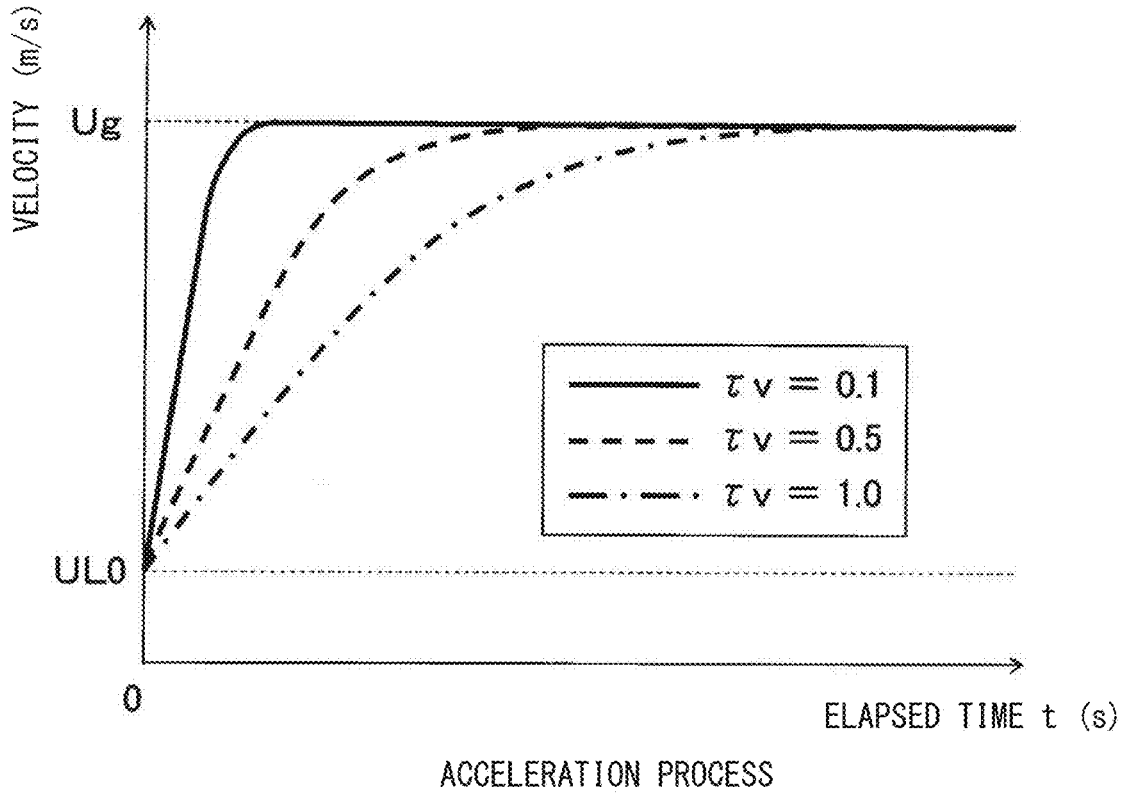
FIG. 3 is a graph showing a change in an average velocity UL in an acceleration process of droplets flowing into the joining portion.
Figure 4:
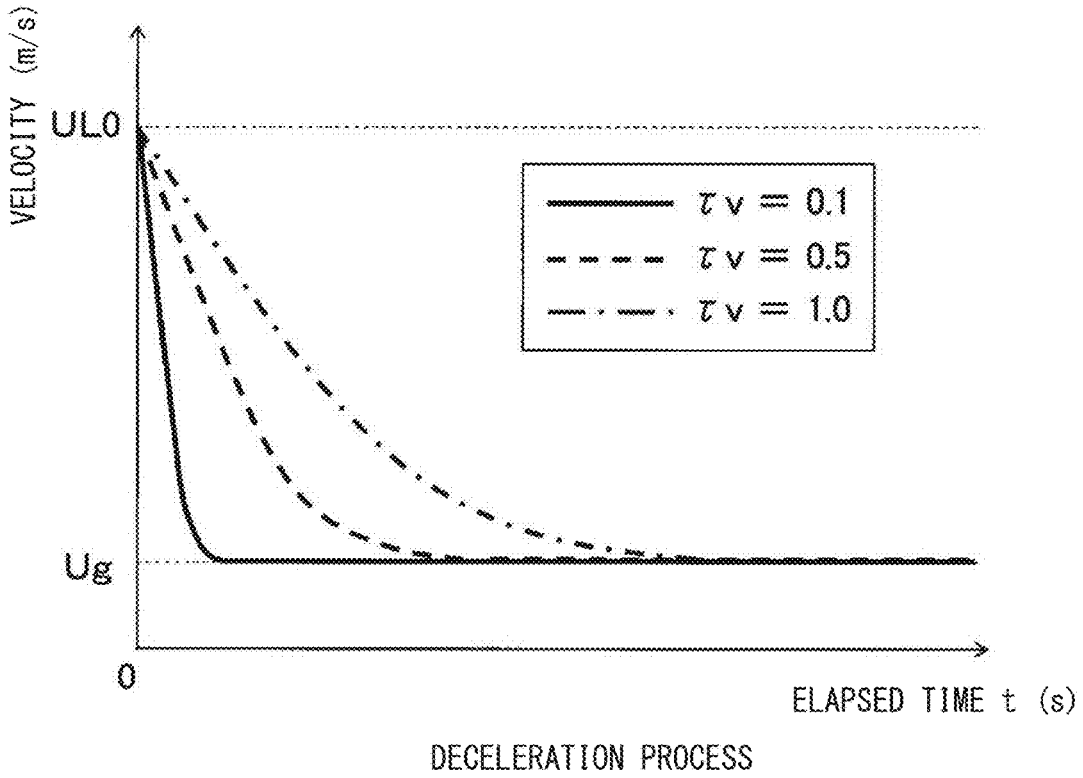
FIG. 4 is a graph showing a change in the average velocity UL in a deceleration process of droplets flowing into the joining portion.

As a result, as illustrated in FIGS. 3 and 4, it has been confirmed that the time required for the average velocity UL of the droplets to reach the average velocity Ug of the gas-phase refrigerant decreases as the velocity relaxation time τv decreases in both the acceleration process and the deceleration process of the droplets. Furthermore, it has been confirmed that as the velocity relaxation time τv decreases, the time when the average velocity UL of the droplets reaches the average velocity Ug of the gas-phase refrigerant is actually approached.

In addition, by expressing the average mass m of the droplets at the junction MX using the average droplet diameter dp at the junction MX, Formula F3 can be deformed as shown in Formula F5.

[Mathematical 6]

$$\tau v = \rho L \times \pi \frac{dp^3}{6} \times \frac{l}{3\pi \times \mu g \times dp} = \frac{\rho L \times dp^2}{18\ \mu g} \quad \text{(F5)}$$

ρL is the density of the droplets at the junction MX.

As is clear from Formula F5, the velocity relaxation time τv is proportional to the number obtained by squaring the average droplet diameter dp at the junction MX. The velocity relaxation time τv is inversely proportional to the viscosity μg of the gas-phase refrigerant at the junction MX. Therefore, as the average droplet diameter dp at the junction MX decreases, the velocity relaxation time τv decreases.

According to the study of the present inventors, it has been found that the measured value of the average droplet diameter dp at the junction MX of the heat pump cycle device of the present embodiment is approximately 3 to 5 μm. Therefore, since the velocity relaxation time τv is a relatively small value, the velocity relaxation time can be used as the time when the average velocity UL of the droplets reaches the average velocity Ug of the gas-phase refrigerant.

Next, the temperature equilibrium between the droplets and the gas-phase refrigerant will be examined. For the temperature equilibrium, it is necessary to examine, for each droplet, both the gas-side heat transfer amount Qg from the droplet interface to the gas-phase refrigerant and the droplet-side heat transfer amount QL from the droplet interface to the inside of the droplet. The gas-side heat transfer amount Qg can be expressed by Formula F6 from Newton's cooling measurement.

[Mathematical 7]

$$\dot{Q}g = \frac{\partial}{\partial t} htg(Tsu - Tsg) \times \pi \times dp^2 \quad \text{(F6)}$$

htg is the heat transfer coefficient of the gas-phase refrigerant. Tsu is the average refrigerant temperature at the droplet interface. Tsg is the average refrigerant temperature of the gas-phase refrigerant.

Furthermore, the gas-side temperature relaxation time τtg corresponding to the velocity relaxation time τv is defined, and Formula F6 is transformed as shown in formula F7.

[Mathematical 8]

$$\frac{dTsg}{dt} = \frac{Tsu - Tsg}{\tau tg} \quad \text{(F7)}$$

Similarly to the velocity relaxation time τv, when Formula F7 is solved, the gas-side temperature relaxation time τtg can be expressed by Formula F8.

[Mathematical 9]

$$\tau tg = \frac{\rho g \times Cpg \times dp}{6htg} \quad \text{(F8)}$$

μg is the density of the gas-phase refrigerant at the junction MX. Cpg is the low-pressure specific heat of the gas-phase refrigerant.

Similarly, the droplet-side heat transfer amount QL can be expressed by Formula F9 from Newton's cooling measurement.

[Mathematical 10]

$$\dot{Q}L = \frac{\partial}{\partial t} htL(Tsu - TsL) \times \pi \times dp^2 \quad \text{(F9)}$$

htL is the heat transfer coefficient of the droplets. TsL is the average refrigerant temperature in the droplets.

Furthermore, the droplet-side temperature relaxation time τtL corresponding to the velocity relaxation time τv is defined, and Formula F9 is deformed as shown in Formula F10.

[Mathematical 11]

$$\frac{dTsL}{dt} = \frac{Tsu - TsL}{\tau tL} \quad \text{(F10)}$$

Similarly to the velocity relaxation time τv, when the above Formula F10 is solved, the droplet-side temperature relaxation time τtL can be expressed by Formula F11.

[Mathematical 12]

$$\tau tL = \frac{\rho L \times CpL \times dp}{6htL} \quad \text{(F11)}$$

CpL is the low-pressure specific heat of the droplets.

Here, the ratio of the gas-side temperature relaxation time τtg to the velocity relaxation time τv can be expressed by Formula F13 using the Prandtl number Prg of the gas-phase refrigerant expressed by Formula F12. Similarly, the ratio of the droplet-side temperature relaxation time τtL to the velocity relaxation time τv can be expressed by Formula F14 using the Prandtl number Prg. The Prandtl number is a dimensionless quantity representing the ratio of the kinematic viscosity coefficient to the thermal diffusion coefficient of a fluid.

[Mathematical 13]

$$Prg = \mu g \frac{Cpg}{\lambda tg} \quad \text{(F12)}$$

λtg is the low-pressure specific heat of the gas-phase refrigerant.

[Mathematical 14]

$$\frac{\tau Tg}{\tau v} = 3\frac{Prg}{Nug}\frac{\rho g}{\rho L} \quad \text{(F13)}$$

Nug is the Nusselt number of the gas-phase refrigerant. The Nusselt number is a dimensionless quantity representing the ratio of heat conduction in a stationary fluid to heat transfer by convection.

[Mathematical 15]

$$\frac{\tau TL}{\tau v} = 3\frac{Prg}{NuL}\frac{CpL}{Cpg}\frac{\lambda tg}{\lambda tL} \quad \text{(F14)}$$

NuL is the Nusselt number of the droplets. λtL is the low-pressure specific heat of the droplets.

According to Formulae F13 and F14, the ratio of the gas-side temperature relaxation time τtg to the velocity relaxation time τv and the ratio of the gas-side temperature relaxation time τtg to the droplet-side temperature relaxation time τtL are determined by the state quantity of the gas-liquid two-phase refrigerant at the junction MX. In other words, the ratio of the gas-side temperature relaxation time τtg to the velocity relaxation time τv and the ratio of the gas-side temperature relaxation time τtg to the droplet-side temperature relaxation time τtL are generally determined by the use environment and physical property values of the refrigerant.

Therefore, the present inventors have investigated the ratio of the gas-side temperature relaxation time τtg to the velocity relaxation time τv and the ratio of the gas-side temperature relaxation time τtg to the droplet-side temperature relaxation time τtL under the use conditions of the heat pump cycle device of the present embodiment. As a result, it has been found that the measured values of the ratio of the gas-side temperature relaxation time τtg to the velocity relaxation time τv and the ratio of the gas-side temperature relaxation time τtg to the droplet-side temperature relaxation time τtL are equal to or less than about 0.01.

That is, it has been found that the temperature equilibrium state is reliably reached when the velocity relaxation time τv, which is the time when the droplets and the gas-phase refrigerant reach the velocity equilibrium state, has elapsed. As a result, in the present embodiment, the relaxation distance Lv is defined as a value obtained by multiplying the average flow velocity Uv of the refrigerant at the junction MX by the velocity relaxation time τv, as shown in Formula F1. In addition, the relaxation distance Lv can be defined by Formula F15 using Formula F1 and Formula F5.

[Mathematical 16]

$$Lv = \frac{\rho L \times dp^2}{18\ \mu g} \times Uv \quad \text{(F15)}$$

As is clear from Formula F15, the relaxation distance Lv is proportional to the value obtained by squaring the average droplet diameter dp at the junction MX, similarly to the velocity relaxation time τv. The relaxation distance Lv is proportional to the average flow velocity Uv. The relaxation distance Lv is inversely proportional to the viscosity μg of the gas-phase refrigerant at the junction MX.

Figure 5:
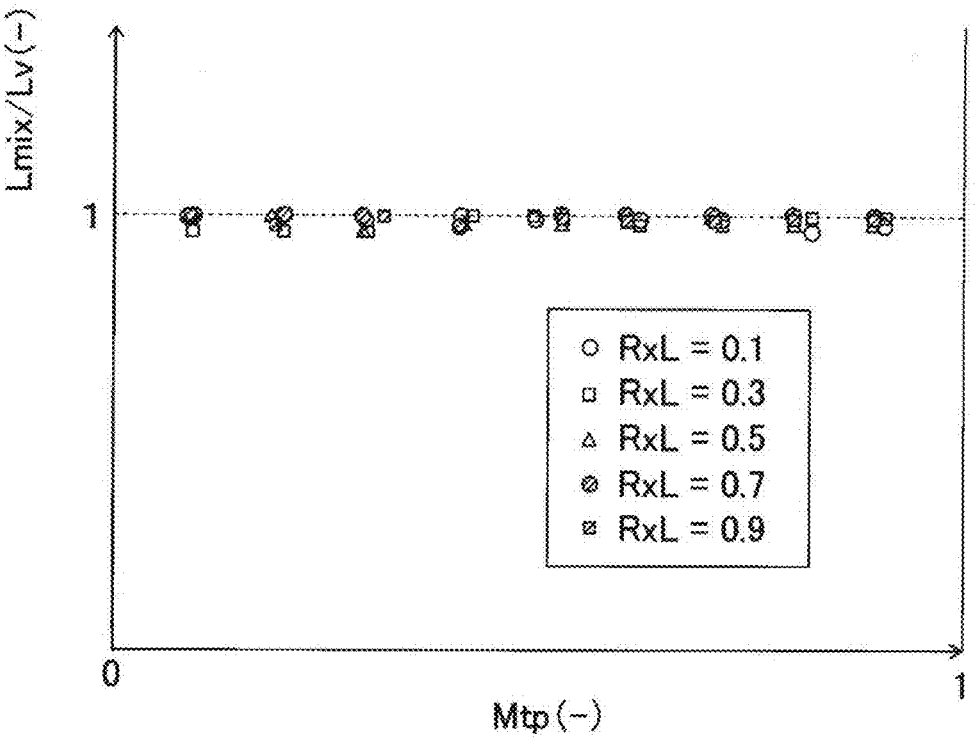
FIG. 5 is a graph showing a change in a distance ratio Lmix/Lv when the Mach number Mtp of a refrigerant at the joining portion is changed.

Furthermore, the present inventors have confirmed the relationship between the relaxation distance Lv and a required distance Lmix. The required distance Lmix is the measured value of the distance required for the refrigerant actually joining at the junction MX of the sixth three-way joint 12*f* to be in a homogeneous state. Specifically, as illustrated in FIG. 5, the change in the distance ratio (Lmix/Lv) of the required distance Lmix to the relaxation distance Lv when the Mach number Mtp is changed has been investigated. The Mach number Mtp is the ratio of the average flow velocity Uv to the speed of sound Us of the gas-liquid two-phase refrigerant.

The relationship between the relaxation distance Lv and the required distance Lmix is confirmed in the range in which the dryness RxL of the heating-unit side refrigerant flowing into the junction MX is equal to or more than 0.1 and equal to or less than 0.9. In addition, the relationship is confirmed in the range in which the degree of superheating of the bypass-side refrigerant flowing into the junction MX is equal to or more than 0.3 K and equal to or less than 30 K. Furthermore, the relationship is confirmed in the range in which the pressure of the refrigerant at the junction MX is equal to or more than 0.08 MPa and equal to or less than 0.77 MPa.

As a result, as illustrated in FIG. 5, it has been confirmed that the distance ratio (Lmix/Lv) is approximately 1 regardless of the Mach number Mtp. That is, it has been confirmed that the relaxation distance Lv substantially matches the required distance Lmix under a wide range of operating conditions. Therefore, the relaxation distance Lv can be used as a flow path length necessary for mixing the refrigerants joined at the sixth three-way joint 12*f* to be in a homogeneous state.

Furthermore, in the present embodiment, not only the suction-side flow path length L1 is set to be equal to or longer than the relaxation distance Lv, but also the suction-side flow path length L1 is not unnecessarily increased in order to prevent an increase in the size of the heat pump cycle 10. For this reason, the actual suction-side flow path length L1 is equal to or less than 50 cm.

Next, the high-temperature side heat medium circuit 30 illustrated in FIG. 1 will be described. The high-temperature side heat medium circuit 30 is a heat medium circuit that circulates a high-temperature side heat medium. In the present embodiment, as the high-temperature side heat medium, an ethylene glycol aqueous solution is used. In the high-temperature side heat medium circuit 30, a heat medium passage of the water-refrigerant heat exchanger 13, a high-temperature side pump 31, a heater core 32, and the like are arranged.

The high-temperature side pump 31 is a high-temperature side heat medium pumping unit that pumps the high-temperature side heat medium flowing out of the heat medium passage of the water-refrigerant heat exchanger 13 to the heat medium inlet port side of the heater core 32. The high-temperature side pump 31 is an electric pump whose rotation speed (that is, pumping performance) is controlled by a control voltage output from the control device 60.

The heater core 32 is a heating heat exchanger that exchanges heat between the high-temperature side heat medium heated by the water-refrigerant heat exchanger 13 and ventilation air passing through the inside evaporator 18 to heat the ventilation air. The heater core 32 is disposed in the air conditioning casing 51 of the interior air conditioning unit 50. An inlet port side of the heat medium passage in the water-refrigerant heat exchanger 13 is connected to a heat-medium outlet port of the heater core 32.

Therefore, the constituent devices of the water-refrigerant heat exchanger 13 and the high-temperature side heat medium circuit 30 of the present embodiment are heating units that heat ventilation air as a heating object using one discharge refrigerant branched at the first three-way joint 12*a* as a heat source.

Next, the low-temperature side heat medium circuit 40 will be described. The low-temperature side heat medium circuit 40 is a heat medium circuit that circulates a low-temperature side heat medium. In the present embodiment, as the low-temperature side heat medium, the same type of fluid as the high-temperature side heat medium is used. In the low-temperature side heat medium circuit 40, a low-temperature side pump 41, a cooling water passage 70*a* of the battery 70, a heat medium passage of the chiller 20, and the like are connected.

The low-temperature side pump 41 is a low-temperature side heat medium pumping unit that pumps the low-temperature side heat medium flowing out of the cooling water passage 70*a* of the battery 70 to the inlet port side of the heat medium passage in the chiller 20. The basic configuration of the low-temperature side pump 41 is similar to that of the high-temperature side pump 31. An inlet port side of the cooling water passage 70*a* in the battery 70 is connected to an outlet port side of the heat medium passage in the chiller 20.

The cooling water passage 70*a* of the battery 70 is a cooling water passage formed to cool the battery 70 by circulating the low-temperature side heat medium cooled by the chiller 20. The cooling water passage 70*a* is formed inside a dedicated battery case that houses a plurality of battery cells arranged in a stacked manner.

The cooling water passage 70*a* has a passage configuration in which a plurality of passages are connected in parallel inside the dedicated battery case. As a result, the cooling water passage 70*a* can uniformly cool all the battery cells. A suction port side of the low-temperature side pump 41 is connected to an outlet port of the cooling water passage 70*a*.

Figure 6:
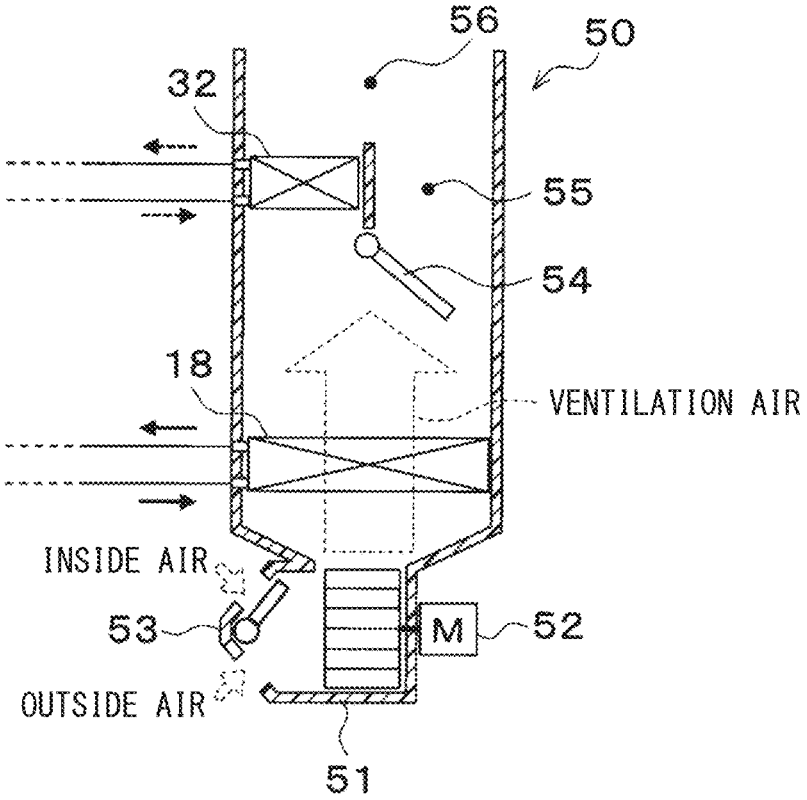
FIG. 6 is a schematic configuration diagram of an interior air conditioning unit of the first embodiment.

Next, the interior air conditioning unit 50 will be described with reference to FIG. 6. The interior air conditioning unit 50 is a unit in which a plurality of constituent devices are integrated in order to blow ventilation air regulated to an appropriate temperature for air conditioning in the vehicle cabin to an appropriate location in the vehicle cabin. The interior air conditioning unit 50 is disposed inside a dashboard (i.e., an instrument panel) at the foremost of the vehicle cabin.

The interior air conditioning unit 50 is formed by housing the inside blower 52, the inside evaporator 18, the heater core 32, and the like in the air conditioning casing 51 forming an air passage for ventilation air. The air conditioning casing 51 is formed of resin (for example, polypropylene) that has a certain degree of elasticity and excellent strength.

An inside-air and outside-air switching device 53 is disposed on the most upstream side in a ventilation air flow of the air conditioning casing 51. The inside-air and outside-air switching device 53 switches inside air (that is, air inside the vehicle cabin) and outside air (that is, air outside the vehicle cabin), and introduces the air into the air conditioning casing 51. The operation of the inside-air and outside-air switching device 53 is controlled by a control signal output from the control device 60.

The inside blower 52 is disposed on the downstream side in the ventilation air flow of the inside-air and outside-air switching device 53. The inside blower 52 is a ventilation unit that supplies air sucked through the inside-air and outside-air switching device 53 to the vehicle cabin. The rotation speed (that is, the ventilation performance) of the inside blower 52 is controlled by a control voltage output from the control device 60.

The inside evaporator 18 and the heater core 32 are arranged on the downstream side in the ventilation air flow of the inside blower 52. The inside evaporator 18 is disposed on the upstream side in the ventilation air flow of the heater core 32. A cold air bypass passage 55 in which the ventilation air after passing through the inside evaporator 18 flows while bypassing the heater core 32 is formed in the air conditioning casing 51.

An air mix door 54 is disposed on the downstream side in the ventilation air flow of the inside evaporator 18 and on the upstream side in the ventilation air flow of the heater core 32 and the cold air bypass passage 55 in the air conditioning casing 51.

The air mix door 54 regulates an air volume ratio between the volume of the ventilation air passing through the heater core 32 side and the volume of the ventilation air passing through the cold air bypass passage 55 in the ventilation air after passing through the inside evaporator 18. The operation of an actuator for driving the air mix door 54 is controlled by a control signal output from the control device 60.

A mixing space 56 is disposed on the downstream side in the ventilation air flow of the heater core 32 and the cold air bypass passage 55. The mixing space 56 is a space for mixing the ventilation air heated by the heater core 32 and the ventilation air passing through the cold air bypass passage 55 and not heated.

Therefore, in the interior air conditioning unit 50, the temperature of the ventilation air (that is, the conditioned air) mixed in the mixing space 56 and blown into the vehicle cabin can be regulated by regulating the opening of the air mix door 54. The air mix door 54 of the present embodiment is an air flow-rate regulating unit that regulates the flow rate of ventilation air subjected to heat exchange in the heater core 32.

A plurality of opening holes (not illustrated) for blowing conditioned air toward various locations in the vehicle cabin are formed in a portion of the air conditioning casing 51 on the most downstream side in the ventilation air flow. A blowing mode door (not illustrated) that opens and closes each opening hole is disposed in each of the plurality of opening holes. The operation of an actuator for driving the blowing mode door is controlled by a control signal output from the control device 60.

Therefore, in the interior air conditioning unit 50, the conditioned air regulated to an appropriate temperature can be blown to an appropriate location in the vehicle cabin by switching the opening holes in which the blowing mode door opens and closes.

Next, an electric control unit of the present embodiment will be described. The control device 60 includes a known microcomputer including a CPU, a ROM, a RAM, and the like, and peripheral circuits thereof. The control device 60 performs various calculations and processing on the basis of a control program stored in the ROM. The control device 60 then controls the operations of the various control target devices 11, 14*a* to 14*d*, 22*a*, 22*b*, 31, 41, 52, 53, and the like connected to the output side on the basis of the calculation and processing results.

Figure 7:
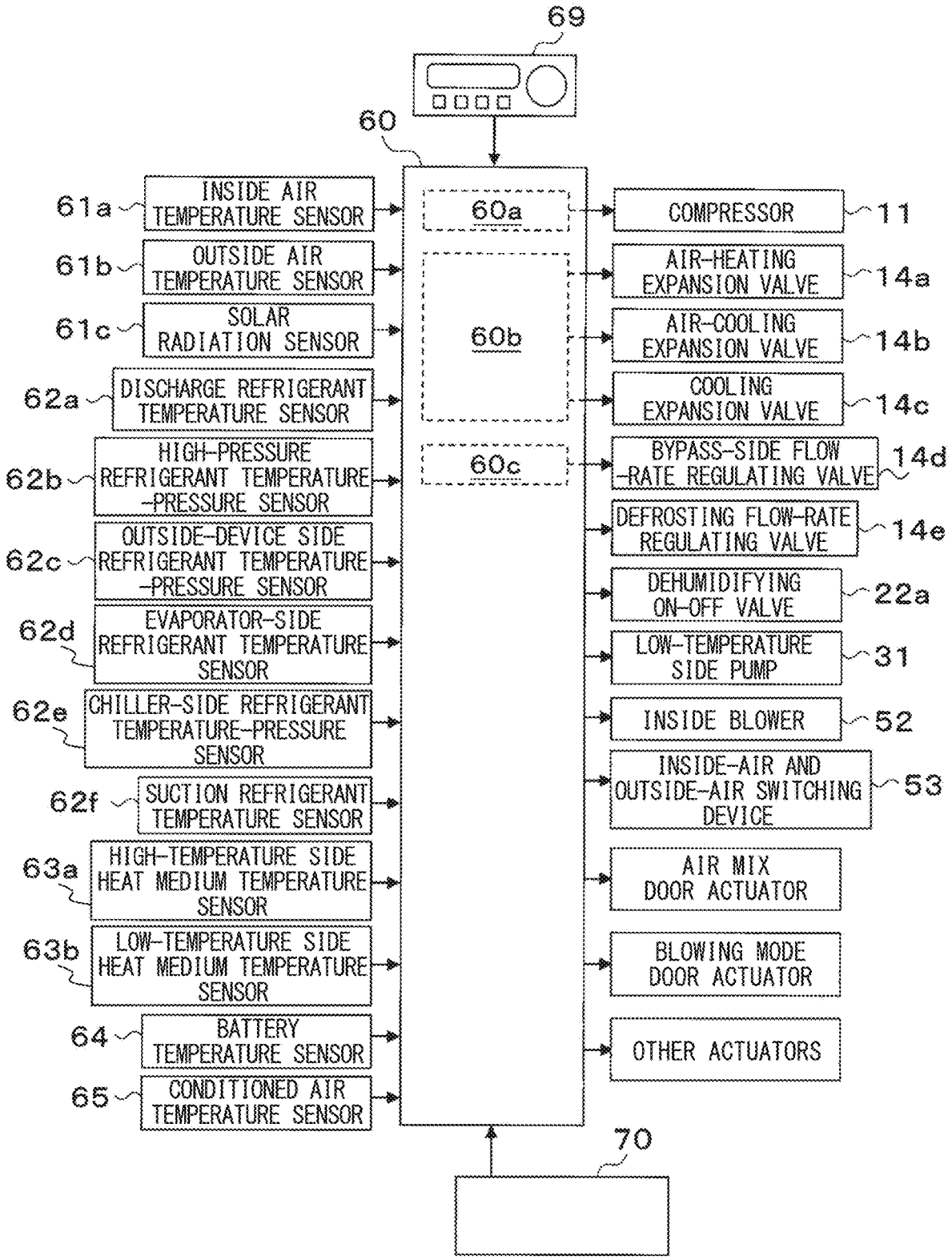
FIG. 7 is a block diagram illustrating an electric control unit of the vehicle air conditioner of the first embodiment.

As illustrated in the block diagram of FIG. 7, a control sensor group including an inside air temperature sensor 61*a*, an outside air temperature sensor 61*b*, a solar radiation sensor 61*c*, a discharge refrigerant temperature sensor 62*a*, a high-pressure side refrigerant temperature-pressure sensor 62*b*, an outside-device side refrigerant temperature-pressure sensor 62*c*, an evaporator temperature sensor 62*d*, a chiller-side refrigerant temperature-pressure sensor 62*e*, a suction refrigerant temperature sensor 62*f*, a high-temperature side heat medium temperature sensor 63*a*, a low-temperature side heat medium temperature sensor 63*b*, a battery temperature sensor 64, a conditioned air temperature sensor 65, and the like is connected to the input side of the control device 60.

The inside air temperature sensor 61*a* is an inside air temperature detection unit that detects a vehicle cabin temperature (inside air temperature) Tr. The outside air temperature sensor 61*b* is an outside air temperature detection unit that detects a temperature outside the vehicle cabin (outside air temperature) Tam. The solar radiation sensor 61*c* is a solar-radiation amount detection unit that detects a solar radiation amount As with which the vehicle cabin is irradiated.

The discharge refrigerant temperature sensor 62*a* is a discharge refrigerant temperature detection unit that detects a discharge refrigerant temperature Td of the discharge refrigerant discharged from the compressor 11.

The evaporator-side temperature sensor 62*d* is an evaporator temperature detection unit that detects a refrigerant evaporating temperature (evaporator temperature) Tefin in the inside evaporator 18. Specifically, the evaporator temperature sensor 62*d* detects a heat-exchange fin temperature of the inside evaporator 18.

The high-pressure refrigerant temperature-pressure sensor 62*b* is a high-pressure side refrigerant temperature pressure detection unit that detects a high-pressure side refrigerant temperature T1, which is the temperature of the refrigerant flowing out of the water-refrigerant heat exchanger 13, and a discharge refrigerant pressure Pd, which is the pressure of the refrigerant flowing out of the water-refrigerant heat exchanger 13. The discharge refrigerant pressure Pd can be used as the pressure of the discharge refrigerant discharged from the compressor 11.

The outside-device side refrigerant temperature-pressure sensor 62*c* is an outside-device side refrigerant temperature pressure detection unit that detects an outside-device side refrigerant temperature T2, which is the temperature of the refrigerant flowing out of the outside heat exchanger 15, and an outside-device side refrigerant pressure P2, which is the pressure of the refrigerant flowing out of the outside heat exchanger 15. Specifically, the temperature and pressure of the refrigerant flowing through the refrigerant passage from the refrigerant outlet port of the outside heat exchanger 15 to one inlet port of the third three-way joint 12*c* are detected.

The chiller-side refrigerant temperature-pressure sensor 62*e* is a chiller-side refrigerant temperature pressure detection unit that detects a chiller-side refrigerant temperature Tc, which is the temperature of the refrigerant flowing out of the refrigerant passage of the chiller 20, and a chiller-side refrigerant pressure Pc, which is the pressure of the refrigerant flowing out of the refrigerant passage of the chiller 20. The chiller-side refrigerant pressure Pc can be used as a suction refrigerant pressure Ps that is the pressure of the suction refrigerant sucked into the compressor 11. Therefore, the chiller-side refrigerant temperature-pressure sensor 62*e* of the present embodiment is a suction pressure detection unit.

In the present embodiment, a detection unit in which a pressure detection unit and a temperature detection unit are integrated is used as a refrigerant temperature-pressure sensor, but it is needless to mention that a pressure detection unit and a temperature detection unit configured as separate units may be used.

The suction refrigerant temperature sensor 62*f* is a suction refrigerant temperature detection unit that is disposed in the suction-side passage 21*d* and detects a suction refrigerant temperature Ts, which is the temperature of the suction refrigerant sucked into the compressor 11. Furthermore, in the present embodiment, as illustrated in FIG. 1, when the length of the flow path from the outlet port of the sixth three-way joint 12*f* to the attachment portion of the suction refrigerant temperature sensor 62*f* in the suction-side passage 21*d* is defined as a detection-unit flow path length L2, the detection-unit flow path length L2 is equal to or longer than the relaxation distance Lv.

Similarly to the suction-side flow path length L1, the detection-unit flow path length L2 can be defined by the length of the center line of a portion from the outlet port of the sixth three-way joint 12*f* to the attachment portion of the suction refrigerant temperature sensor 62*f* in the pipe forming the suction-side passage 21*d*.

The high-temperature side heat medium temperature sensor 63*a* is a high-temperature side heat medium temperature detection unit that detects a high-temperature side heat medium temperature TWH that is the temperature of the high-temperature side heat medium flowing into the heater core 32. The low-temperature side heat medium temperature sensor 63*b* is a low-temperature side heat medium temperature detection unit that detects a low-temperature side heat medium temperature TWL that is the temperature of the low-temperature side heat medium flowing into the cooling water passage 70*a* of the battery 70.

The battery temperature sensor 64 is a battery temperature detection unit that detects a battery temperature TB that is the temperature of the battery 70. The battery temperature sensor 64 includes a plurality of temperature sensors, and detects temperatures at a plurality of portions of the battery 70. Therefore, the control device 60 can detect a temperature difference between and a temperature distribution of the individual battery cells forming the battery 70. Furthermore, the average value of detection values of the plurality of temperature sensors is used as the battery temperature TB.

The conditioned air temperature sensor 65 is a conditioned air temperature detection unit that detects a ventilation air temperature TAV of the ventilation air supplied into the vehicle cabin from the mixing space 56. The ventilation air temperature TAV is an object temperature of the ventilation air as a heating object.

Furthermore, as illustrated in FIG. 7, an operation panel 69 disposed near the instrument panel at the front of the vehicle cabin is connected to the input side of the control device 60 in a wired or wireless manner. Operation signals from various operation switches provided on the operation panel 69 are input to the control device 60.

Specific examples of the various operation switches provided on the operation panel 69 include an automatic switch, an air conditioner switch, an air volume setting switch, and a temperature setting switch.

The automatic switch is an automatic control setting unit that sets or cancels the automatic control operation of the vehicle air conditioner 1. The air conditioner switch is a cooling request unit that requests the inside evaporator 18 to cool ventilation air. The air volume setting switch is an air volume setting unit that manually sets the air volume of the inside blower 52. The temperature setting switch is a temperature setting unit that sets a set temperature Tset in the vehicle cabin.

The control device 60 of the present embodiment is integrally configured with a control unit that controls various control target devices connected to the output side of the control device. Therefore, a configuration (that is, hardware and software) that controls the operation of each control target device configures the control unit that controls the operation of each control target device.

For example, the configuration in the control device 60 that controls the refrigerant discharge performance of the compressor 11 configures a discharge performance control unit 60*a*. The configuration of controlling the operation of the heating-unit side decompression unit (in the present embodiment, the air-heating expansion valve 14*a* and the air-cooling expansion valve 14*b*, and the cooling expansion valve 14*c*) configures a heating-unit side control unit 60*b*. The configuration of controlling the operation of the bypass-side flow-rate regulating valve 14*d* configures a bypass-side control unit 60*c*.

Next, the operation of the vehicle air conditioner 1 of the present embodiment with the above configuration will be described. In the vehicle air conditioner 1 of the present embodiment, various operation modes are switched in order to perform air conditioning in the vehicle cabin and temperature regulation of the battery 70. These operation modes are switched by executing a control program stored in advance in the control device 60. Various operation modes will be described below.

First, an operation mode in which the refrigerant does not flow through the bypass passage 21*c* will be described. Examples of the operation mode in which the refrigerant does not flow through the bypass passage 21*c* include (a) air-cooling mode, (b) series dehumidification and air-heating mode, and (c) outside-air heat-absorption and air-heating mode.

(a) Air-Cooling Mode

The air-cooling mode is an operation mode in which the air in the vehicle cabin is cooled by blowing cooled ventilation air into the vehicle cabin. In the control program, the air-cooling mode is selected mainly in summer when the outside air temperature Tam is relatively high (25° C. or higher in the present embodiment).

The air-cooling mode includes a single air-cooling mode and a cooling and air-cooling mode. The single air-cooling mode is an operation mode in which the air in the vehicle cabin is cooled without cooling the battery 70. The cooling and air-cooling mode is an operation mode in which the battery 70 is cooled and at the same time, the air in the vehicle cabin is cooled.

In the control program of the present embodiment, the operation mode of cooling the battery 70 is performed when the battery temperature TB detected by the battery temperature sensor 64 is equal to or higher than a predetermined reference upper limit temperature KTBH. The same applies to other operation modes described below.

(a-1) Single Air-Cooling Mode

In the heat pump cycle 10 in the single air-cooling mode, the control device 60 brings the air-heating expansion valve 14*a* into a fully open state, brings the air-cooling expansion valve 14*b* into a throttled state where the refrigerant decompression action is exhibited, brings the cooling expansion valve 14*c* into a fully closed state, and brings the bypass-side flow-rate regulating valve 14*d* into the fully closed state. In addition, the control device 60 closes the dehumidifying on-off valve 22*a* and also closes the air-heating on-off valve 22*b*.

Therefore, in the heat pump cycle 10 in the single air-cooling mode, the refrigerant circuit is switched to a refrigerant circuit in which the refrigerant discharged from the compressor 11 circulates through the water-refrigerant heat exchanger 13, the air-heating expansion valve 14*a* in the fully open state, the outside heat exchanger 15, the air-cooling expansion valve 14*b* in the throttled state, the inside evaporator 18, the suction-side passage 21*d*, and the suction port of the compressor 11 in this order.

The control device 60 controls the refrigerant discharge performance of the compressor 11 in such a manner that the evaporator temperature Tefin detected by the evaporator temperature sensor 62*d* approaches a target evaporator temperature TEO. The target evaporator temperature TEO is determined on the basis of a target blowing temperature TAO with reference to a control map stored in advance in the control device 60.

The target blowing temperature TAO is a target temperature of ventilation air to be blown into the vehicle cabin. The target blowing temperature TAO is calculated using the inside air temperature Tr detected by the inside air temperature sensor 61*a*, the outside air temperature Tam, the solar radiation amount As detected by the solar radiation sensor 61*c*, the set temperature Tset set by the temperature setting switch, and the like. In the control map, the target evaporator temperature TEO is determined to increase as the target blowing temperature TAO increases.

The control device 60 controls the throttle opening of the air-cooling expansion valve 14*b* in such a manner that the degree of superheating SH of the suction refrigerant approaches a predetermined reference degree of superheating KSH (in the present embodiment, 5° C.). The degree of superheating SH of the suction refrigerant can be determined using the chiller-side refrigerant pressure Pc detected by the chiller-side refrigerant temperature-pressure sensor 62*e* and the suction refrigerant temperature Ts detected by the suction refrigerant temperature sensor 62*f*.

In the high-temperature side heat medium circuit 30 in the single air-cooling mode, the control device 60 operates the high-temperature side pump 31 so as to exhibit the predetermined reference pumping performance. Therefore, in the high-temperature side heat medium circuit 30 in the single air-cooling mode, the heat medium pumped from the high-temperature side pump 31 circulates through the heat medium passage of the water-refrigerant heat exchanger 13, the heater core 32, and the suction port of the high-temperature side pump 31 in this order.

Furthermore, in the interior air conditioning unit 50 in the single air-cooling mode, the control device 60 controls the ventilation performance of the inside blower 52 on the basis of the target blowing temperature TAO with reference to the control map stored in advance in the control device 60. The control device 60 regulates the opening of the air mix door 54 in a manner that the ventilation air temperature TAV detected by the conditioned air temperature sensor 65 approaches the target blowing temperature TAO. The control device 60 appropriately controls the operations of other control target devices.

Therefore, in the heat pump cycle 10 in the single air-cooling mode, a vapor compression refrigeration cycle is configured in which the water-refrigerant heat exchanger 13 and the outside heat exchanger 15 function as condensers that radiate heat of the refrigerant and condense the refrigerant, and the inside evaporator 18 functions as an evaporator that evaporates the refrigerant.

In the high-temperature side heat medium circuit 30 in the single air-cooling mode, the high-temperature side heat medium heated by the water-refrigerant heat exchanger 13 flows into the heater core 32.

In the interior air conditioning unit 50 in the single air-cooling mode, the ventilation air supplied by the inside blower 52 is cooled by the inside evaporator 18. The ventilation air cooled by the inside evaporator 18 is reheated by the heater core 32 so as to approach the target blowing temperature TAO based on the opening of the air mix door 54. The ventilation air with a regulated temperature is blown into the vehicle cabin, so that the air in the vehicle cabin is cooled.

(a-2) Cooling and Air-Cooling Mode

In the heat pump cycle 10 in the cooling and air-cooling mode, the control device 60 brings the cooling expansion valve 14*c* into the throttled state as compared with the single air-cooling mode.

Therefore, in the heat pump cycle 10 in the cooling and air-cooling mode, the refrigerant discharged from the compressor 11 circulates similarly to the single air-cooling mode. At the same time, the refrigerant circuit is switched to a refrigerant circuit in which the refrigerant discharged from the compressor 11 circulates through the water-refrigerant heat exchanger 13, the air-heating expansion valve 14*a* in the fully open state, the outside heat exchanger 15, the cooling expansion valve 14*c* in the throttled state, the chiller 20, the suction-side passage 21*d*, and the suction port of the compressor 11 in this order. That is, the refrigerant circuit is switched to a refrigerant circuit in which the inside evaporator 18 and the chiller 20 are connected in parallel to the refrigerant flow.

The control device 60 controls the throttle opening of the cooling expansion valve 14*c* to a predetermined throttle opening for the cooling and air-cooling mode.

In the high-temperature side heat medium circuit 30 in the cooling and air-cooling mode, the control device 60 operates the high-temperature side pump 31 as in the single air-cooling mode.

In the low-temperature side heat medium circuit 40 in the cooling and air-cooling mode, the control device 60 operates the low-temperature side pump 41 so as to exhibit the predetermined reference pumping performance. Therefore, in the low-temperature side heat medium circuit 40 in the single air-cooling mode, the heat medium pumped from the low-temperature side pump 41 circulates through the heat medium passage of the chiller 20, the cooling water passage 70*a* of the battery 70, and the suction port of the low-temperature side pump 41 in this order.

In the interior air conditioning unit 50 in the cooling and air-cooling mode, the control device 60 controls the ventilation performance of the inside blower 52 and the opening of the air mix door 54 as in the single air-cooling mode. In addition, the control device 60 appropriately controls the operations of other control target devices as in the single air-cooling mode.

Therefore, in the heat pump cycle 10 in the cooling and air-cooling mode, a vapor compression refrigeration cycle is configured in which the water-refrigerant heat exchanger 13 and the outside heat exchanger 15 function as condensers, and the inside evaporator 18 and the chiller 20 function as evaporators.

In the high-temperature side heat medium circuit 30 in the cooling and air-cooling mode, the high-temperature side heat medium heated by the water-refrigerant heat exchanger 13 flows into the heater core 32 as in the single air-cooling mode.

In the low-temperature side heat medium circuit 40 in the cooling and air-cooling mode, the low-temperature side heat medium pumped from the low-temperature side pump 41 flows into the chiller 20. The low-temperature side heat medium flowing into the chiller 20 exchanges heat with the low-pressure refrigerant and is cooled. The low-temperature side heat medium cooled by the chiller 20 flows through the cooling water passage 70*a* of the battery 70. As a result, the battery 70 is cooled.

In the interior air conditioning unit 50 in the cooling and air-cooling mode, the ventilation air with a regulated temperature is blown into the vehicle cabin, so that the air in the vehicle cabin is cooled, as in the single air-cooling mode.

(b) Series Dehumidification and Air-Heating Mode

The series dehumidification and air-heating mode is an operation mode in which the air in the vehicle cabin is dehumidified and heated by reheating cooled and dehumidified ventilation air and blowing the reheated ventilation air into the vehicle cabin. In the control program, the series dehumidification and air-heating mode is selected when the outside air temperature Tam is a temperature in a predetermined medium to high temperature range (equal to or higher than 10° C. and lower than 25° C. in the present embodiment).

Examples of the series dehumidification and air-heating mode include a single series dehumidification and air-heating mode and a cooling series dehumidification and air-heating mode. The single series dehumidification and air-heating mode is an operation mode in which the air in the vehicle cabin is dehumidified and heated without cooling the battery 70. The cooling series dehumidification and air-heating mode is an operation mode in which the battery 70 is cooled, and at the same time, the air in the vehicle cabin is dehumidified and heated.

(b-1) Single Series Dehumidification and Air-Heating Mode

In the heat pump cycle 10 in the single series dehumidification and air-heating mode, the control device 60 brings the air-heating expansion valve 14*a* into the throttled state, brings the air-cooling expansion valve 14*b* into the throttled state, brings the cooling expansion valve 14*c* into the fully closed state, and brings the bypass-side flow-rate regulating valve 14*d* into the fully closed state. In addition, the control device 60 closes the dehumidifying on-off valve 22*a* and also closes the air-heating on-off valve 22*b*.

Therefore, in the heat pump cycle 10 in the single series dehumidification and air-heating mode, the refrigerant circuit is switched to a refrigerant circuit in which the refrigerant discharged from the compressor 11 circulates through the water-refrigerant heat exchanger 13, the air-heating expansion valve 14*a* in the throttled state, the outside heat exchanger 15, the air-cooling expansion valve 14*b* in the throttled state, the inside evaporator 18, the suction-side passage 21*d*, and the suction port of the compressor 11 in this order.

In addition, the control device 60 controls the throttle opening of the air-heating expansion valve 14*a* and the throttle opening of the air-cooling expansion valve 14*b* with reference to the control map stored in advance in the control device 60. In the control map, the throttle opening of the air-heating expansion valve 14*a* and the throttle opening of the air-cooling expansion valve 14*b* are determined in a manner that the degree of superheating SH of the suction refrigerant approaches the reference degree of superheating KSH.

In the high-temperature side heat medium circuit 30 in the single series dehumidification and air-heating mode, the control device 60 operates the high-temperature side pump 31 as in the single air-cooling mode.

In the interior air conditioning unit 50 in the single series dehumidification and air-heating mode, the control device 60 controls the ventilation performance of the inside blower 52 and the opening of the air mix door 54 as in the single air-cooling mode. The control device 60 appropriately controls the operations of other control target devices.

Therefore, in the heat pump cycle 10 in the single series dehumidification and air-heating mode, a vapor compression refrigeration cycle is configured in which the water-refrigerant heat exchanger 13 functions as a condenser, and the inside evaporator 18 functions as an evaporator.

In addition, in the single series dehumidification and air-heating mode, in a case where the saturation temperature of the refrigerant in the outside heat exchanger 15 is higher than the outside air temperature Tam, the outside heat exchanger 15 functions as a condenser. In a case where the saturation temperature of the refrigerant in the outside heat exchanger 15 is lower than the outside air temperature Tam, the outside heat exchanger 15 functions as an evaporator.

In the high-temperature side heat medium circuit 30 in the single series dehumidification and air-heating mode, the high-temperature side heat medium heated by the water-refrigerant heat exchanger 13 flows into the heater core 32.

In the interior air conditioning unit 50 in the single series dehumidification and air-heating mode, the ventilation air supplied by the inside blower 52 is cooled and dehumidified by the inside evaporator 18. The ventilation air cooled and dehumidified by the inside evaporator 18 is reheated by the heater core 32 so as to approach the target blowing temperature TAO based on the opening of the air mix door 54. The ventilation air with a regulated temperature is blown into the vehicle cabin, so that the air in the vehicle cabin is dehumidified and heated.

(b-2) Cooling Series Dehumidification and Air-Heating Mode

In the heat pump cycle 10 in the cooling series dehumidification and air-heating mode, the control device 60 brings the cooling expansion valve 14*c* into the throttled state as compared with the single series dehumidification and air-heating mode.

Therefore, in the heat pump cycle 10 in the cooling series dehumidification and air-heating mode, the refrigerant discharged from the compressor 11 circulates similarly to the single series dehumidification and air-heating mode. At the same time, the refrigerant circuit is switched to a refrigerant circuit in which the refrigerant discharged from the compressor 11 circulates through the water-refrigerant heat exchanger 13, the air-heating expansion valve 14*a* in the throttled state, the outside heat exchanger 15, the cooling expansion valve 14*c* in the throttled state, the chiller 20, the suction-side passage 21*d*, and the suction port of the compressor 11 in this order. That is, the refrigerant circuit is switched to a refrigerant circuit in which the inside evaporator 18 and the chiller 20 are connected in parallel to the refrigerant flow.

In the high-temperature side heat medium circuit 30 in the cooling series dehumidification and air-heating mode, the control device 60 operates the high-temperature side pump 31 as in the single air-cooling mode.

In the low-temperature side heat medium circuit 40 in the cooling series dehumidification and air-heating mode, the control device 60 operates the low-temperature side pump 41 as in the cooling and air-cooling mode.

In the interior air conditioning unit 50 in the cooling series dehumidification and air-heating mode, the control device 60 controls the ventilation performance of the inside blower 52 and the opening of the air mix door 54 as in the single air-cooling mode. In addition, the control device 60 appropriately controls the operations of other control target devices as in the single series dehumidification and air-heating mode.

Therefore, in the heat pump cycle 10 in the cooling series dehumidification and air-heating mode, a vapor compression refrigeration cycle is configured in which the water-refrigerant heat exchanger 13 functions as a condenser, and the inside evaporator 18 and the chiller 20 function as evaporators.

In addition, in the cooling series dehumidification and air-heating mode, in a case where the saturation temperature of the refrigerant in the outside heat exchanger 15 is higher than the outside air temperature Tam, the outside heat exchanger 15 functions as a condenser as in the single series dehumidification and air-heating mode. In a case where the saturation temperature of the refrigerant in the outside heat exchanger 15 is lower than the outside air temperature Tam, the outside heat exchanger 15 functions as an evaporator.

In the high-temperature side heat medium circuit 30 in the cooling series dehumidification and air-heating mode, the high-temperature side heat medium heated by the water-refrigerant heat exchanger 13 flows into the heater core 32 as in the single air-cooling mode.

In the low-temperature side heat medium circuit 40 in the cooling series dehumidification and air-heating mode, as in the cooling and air-cooling mode, the low-temperature side heat medium cooled by the chiller 20 flows through the cooling water passage 70*a* of the battery 70, so that the battery 70 is cooled.

In the interior air conditioning unit 50 in the cooling series dehumidification and air-heating mode, the ventilation air with a regulated temperature is blown into the vehicle cabin, so that the air in the vehicle cabin is dehumidified and heated, as in the single series dehumidification and air-heating mode.

(c) Outside-Air Heat-Absorption and Air-Heating Mode

The outside-air heat-absorption and air-heating mode is an operation mode in which the air in the vehicle cabin is heated by blowing heated ventilation air into the vehicle cabin. In the control program, the outside-air heat-absorption and air-heating mode is selected mainly in winter when the outside air temperature Tam is relatively low (equal to or higher than −10° C. and lower than 0° C. in the present embodiment).

Examples of the outside-air heat-absorption and air-heating mode include a single outside-air heat-absorption and air-heating mode and a cooling outside-air heat-absorption and air-heating mode. The single outside-air heat-absorption and air-heating mode is an operation mode in which the air in the vehicle cabin is heated without cooling the battery 70. The cooling outside-air heat-absorption and air-heating mode is an operation mode in which the battery 70 is cooled and at the same time, the air in the vehicle cabin is heated.

(c-1) Single Outside-Air Heat-Absorption and Air-Heating Mode

In the heat pump cycle 10 in the single outside-air heat-absorption and air-heating mode, the control device 60 brings the air-heating expansion valve 14*a* into the throttled state, brings the air-cooling expansion valve 14*b* into the fully closed state, brings the cooling expansion valve 14*c* into the fully closed state, and brings the bypass-side flow-rate regulating valve 14*d* into the fully closed state. The control device 60 closes the dehumidifying on-off valve 22*a* and opens the air-heating on-off valve 22*b*.

Therefore, in the heat pump cycle 10 in the single outside-air heat-absorption and air-heating mode, the refrigerant circuit is switched to a refrigerant circuit in which the refrigerant discharged from the compressor 11 circulates through the water-refrigerant heat exchanger 13, the air-heating expansion valve 14*a* in the throttled state, the outside heat exchanger 15, the air-heating passage 21*b*, the suction-side passage 21*d*, and the suction port of the compressor 11 in this order.

In addition, the control device 60 controls the refrigerant discharge performance of the compressor 11 in a manner that the discharge refrigerant pressure Pd detected by the high-pressure side refrigerant temperature-pressure sensor 62*b* approaches a target high pressure PDO. The target high pressure PDO is determined on the basis of the target blowing temperature TAO with reference to the control map stored in advance in the control device 60. In the control map, the target high pressure PDO is determined to increase as the target blowing temperature TAO increases.

The control device 60 also controls the throttle opening of the air-heating expansion valve 14*a* in a manner that the degree of superheating SH of the suction refrigerant approaches the reference degree of superheating KSH.

In the high-temperature side heat medium circuit 30 in the single outside-air heat-absorption and air-heating mode, the control device 60 operates the high-temperature side pump 31 as in the single air-cooling mode.

In the interior air conditioning unit 50 in the single outside-air heat-absorption and air-heating mode, the control device 60 controls the ventilation performance of the inside blower 52 and the opening of the air mix door 54 as in the single air-cooling mode. The control device 60 appropriately controls the operations of other control target devices.

Therefore, in the heat pump cycle 10 in the single outside-air heat-absorption and air-heating mode, a vapor compression refrigeration cycle is configured in which the water-refrigerant heat exchanger 13 functions as a condenser and the outside heat exchanger 15 functions as an evaporator.

In the single outside-air heat-absorption and air-heating mode, the high-temperature side heat medium heated by the water-refrigerant heat exchanger 13 flows into the heater core 32 as in the single air-cooling mode.

In the interior air conditioning unit 50 in the single outside-air heat-absorption and air-heating mode, the ventilation air supplied by the inside blower 52 passes through the inside evaporator 18. The ventilation air having passed through the inside evaporator 18 is heated by the heater core 32 so as to approach the target blowing temperature TAO based on the opening of the air mix door 54. The ventilation air with a regulated temperature is blown into the vehicle cabin, so that the air in the vehicle cabin is heated.

(c-2) Cooling Outside-Air Heat-Absorption and Air-Heating Mode

In the heat pump cycle 10 in the cooling outside-air heat-absorption and air-heating mode, the control device 60 brings the cooling expansion valve 14*c* into the throttled state as compared with the single outside-air heat-absorption and air-heating mode. The control device 60 opens the dehumidifying on-off valve 22*a*.

Therefore, in the heat pump cycle 10 in the cooling outside-air heat-absorption and air-heating mode, the refrigerant discharged from the compressor 11 circulates similarly to the single outside-air heat-absorption and air-heating mode. At the same time, the refrigerant circuit is switched to a refrigerant circuit in which the refrigerant discharged from the compressor 11 circulates through the water-refrigerant heat exchanger 13, the dehumidifying passage 21*a*, the cooling expansion valve 14*c* in the throttled state, the chiller 20, the suction-side passage 21*d*, and the suction port of the compressor 11 in this order. That is, the refrigerant circuit is switched to a refrigerant circuit in which the outside heat exchanger 15 and the chiller 20 are connected in parallel to the refrigerant flow.

In the high-temperature side heat medium circuit 30 in the cooling outside-air heat-absorption and air-heating mode, the control device 60 operates the high-temperature side pump 31 as in the single air-cooling mode.

In the low-temperature side heat medium circuit 40 in the cooling outside-air heat-absorption and air-heating mode, the control device 60 operates the low-temperature side pump 41 as in the cooling and air-cooling mode.

In the interior air conditioning unit 50 in the cooling outside-air heat-absorption and air-heating mode, the control device 60 controls the ventilation performance of the inside blower 52 and the opening of the air mix door 54 as in the single air-cooling mode. In addition, the control device 60 appropriately controls the operations of other control target devices as in the single outside-air heat-absorption and air-heating mode.

Therefore, in the heat pump cycle 10 in the cooling outside-air heat-absorption and air-heating mode, a vapor compression refrigeration cycle is configured in which the water-refrigerant heat exchanger 13 functions as a condenser, and the outside heat exchanger 15 and the chiller 20 function as evaporators.

In the high-temperature side heat medium circuit 30 in the cooling outside-air heat-absorption and air-heating mode, the high-temperature side heat medium heated by the water-refrigerant heat exchanger 13 flows into the heater core 32 as in the single air-cooling mode.

In the low-temperature side heat medium circuit 40 in the cooling outside-air heat-absorption and air-heating mode, as in the cooling and air-cooling mode, the low-temperature side heat medium cooled by the chiller 20 flows through the cooling water passage 70*a* of the battery 70, so that the battery 70 is cooled.

In the interior air conditioning unit 50 in the cooling outside-air heat-absorption and air-heating mode, as in the single outside-air heat-absorption and air-heating mode, the ventilation air with a regulated temperature is blown into the vehicle cabin, so that the air in the vehicle cabin is heated.

Next, an operation mode in which the refrigerant flows through the bypass passage 21*c* will be described. Examples of the operation mode in which the refrigerant flows through the bypass passage 21*c* include (d) hot-gas air-heating mode, (e) hot-gas dehumidification and air-heating mode, and (f) hot-gas series dehumidification and air-heating mode.

(d) Hot-Gas Air-Heating Mode

The hot-gas air-heating mode is an operation mode in which the air in the vehicle cabin is heated. In the control program, the hot-gas air-heating mode is selected when the outside air temperature Tam is extremely low (lower than −10° C. in the present embodiment) or when it is determined that the heating performance of the ventilation air in the water-refrigerant heat exchanger 13 is insufficient in the outside-air heat-absorption and air-heating mode.

In the control program, when the ventilation air temperature TAV is lower than the target blowing temperature TAO, it is determined that the heating performance of the ventilation air is insufficient. The same applies to other operation modes.

Examples of the hot-gas air-heating mode include a single hot-gas air-heating mode and a cooling hot-gas air-heating mode. The single hot-gas air-heating mode is an operation mode in which the air in the vehicle cabin is heated without cooling the battery 70. The cooling hot-gas air-heating mode is an operation mode in which the battery 70 is cooled, and at the same time, the air in the vehicle cabin is heated.

(d-1) Single Hot-Gas Air-Heating Mode

In the heat pump cycle 10 in the single hot-gas air-heating mode, the control device 60 brings the air-heating expansion valve 14*a* into the fully closed state, brings the air-cooling expansion valve 14*b* into the fully closed state, brings the cooling expansion valve 14*c* into the throttled state, and brings the bypass-side flow-rate regulating valve 14*d* into the throttled state. The control device 60 opens the dehumidifying on-off valve 22*a* and closes the air-heating on-off valve 22*b*.

Figure 8:
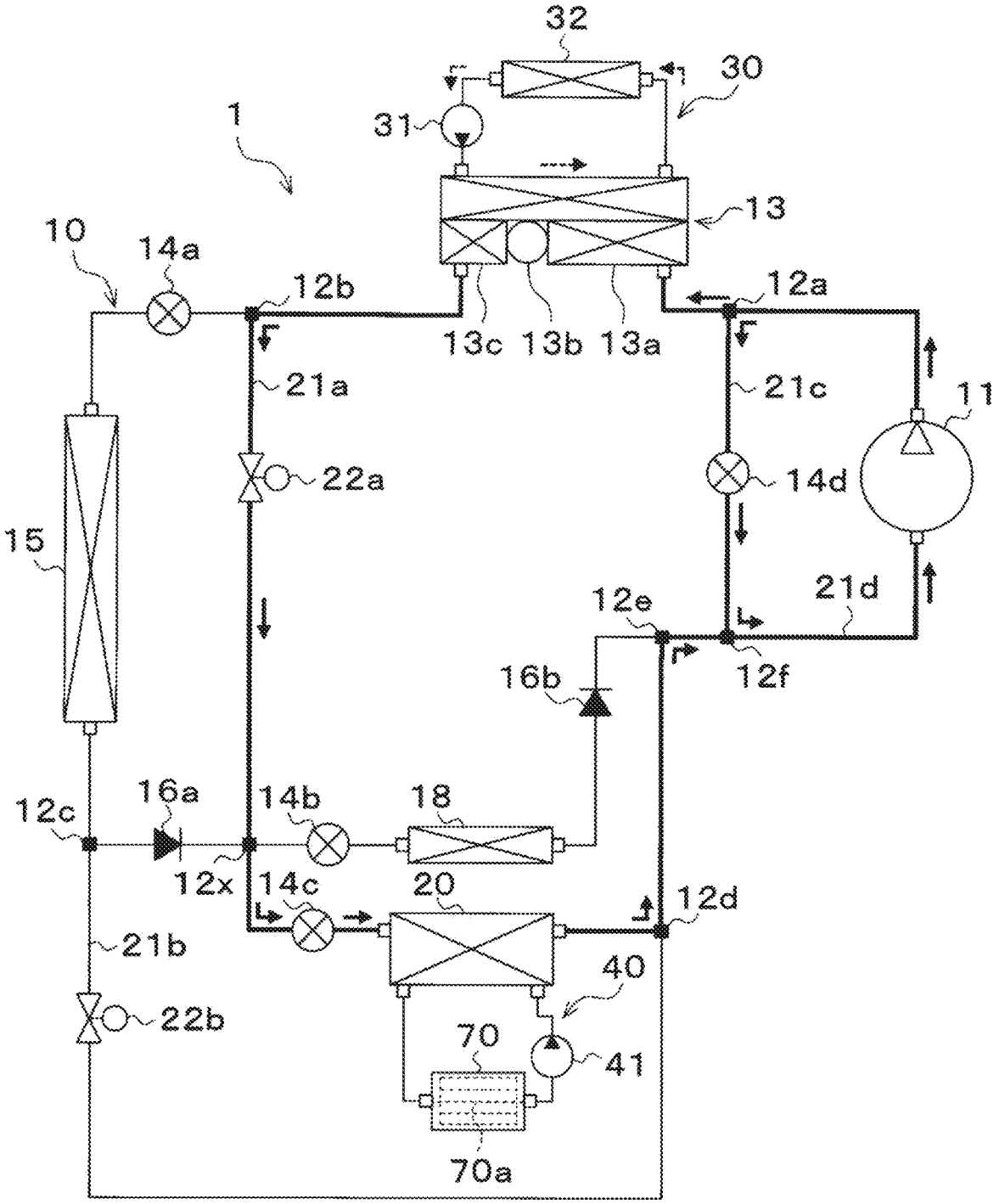
FIG. 8 is a schematic overall configuration diagram illustrating a flow of the refrigerant in a single hot-gas air-heating mode of a heat pump cycle in the first embodiment.

Therefore, in the heat pump cycle 10 in the single hot-gas air-heating mode, as indicated by solid arrows in FIG. 8, the refrigerant discharged from the compressor 11 circulates through the first three-way joint 12*a*, the water-refrigerant heat exchanger 13, the dehumidifying passage 21*a*, the cooling expansion valve 14*c* in the throttled state, the chiller 20, the suction-side passage 21*d*, and the suction port of the compressor 11 in this order. At the same time, the refrigerant circuit is switched to a refrigerant circuit in which the refrigerant discharged from the compressor 11 circulates through the first three-way joint 12*a*, the bypass-side flow-rate regulating valve 14*d* in the throttled state, which is disposed in the bypass passage 21*c*, the suction-side passage 21*d*, and the suction port of the compressor 11 in this order.

Furthermore, the control device 60 controls the refrigerant discharge performance of the compressor 11 in a manner that the chiller-side refrigerant pressure Pc approaches a predetermined first target low pressure PSO1.

Controlling the chiller-side refrigerant pressure Pc corresponding to the suction refrigerant pressure Ps so as to approach a constant pressure is effective for stabilizing a discharge flow rate Gr (mass flow rate) of the compressor 11. More specifically, by generating a saturated gas-phase refrigerant with a constant pressure as the suction refrigerant pressure Ps, the density of the suction refrigerant becomes constant. Therefore, when the suction refrigerant pressure Ps is controlled so as to approach a constant pressure, the discharge flow rate Gr of the compressor 11 at the same rotation speed is easily stabilized.

In addition, the control device 60 controls the throttle opening of the bypass-side flow-rate regulating valve 14*d* in a manner that the discharge refrigerant pressure Pd approaches the target high pressure PDO.

The control device 60 also controls the throttle opening of the cooling expansion valve 14*c* in a manner that the degree of superheating SH of the suction refrigerant approaches the reference degree of superheating KSH.

In the high-temperature side heat medium circuit 30 in the single hot-gas air-heating mode, the control device 60 operates the high-temperature side pump 31 as in the single air-cooling mode.

In the low-temperature side heat medium circuit 40 in the single hot-gas air-heating mode, the control device 60 stops the low-temperature side pump 41.

In the interior air conditioning unit 50 in the single hot-gas air-heating mode, the control device 60 controls the opening of the air mix door 54 as in the single air-cooling mode. In the hot-gas air-heating mode, the opening of the air mix door 54 is often controlled in a manner that almost the entire volume of ventilation air supplied by the inside blower 52 passes through the heater core 32.

The control device 60 controls the operation of the inside-air and outside-air switching device 53 to introduce the inside air into the air conditioning casing 51. The control device 60 appropriately controls the operations of other control target devices.

Figure 9:
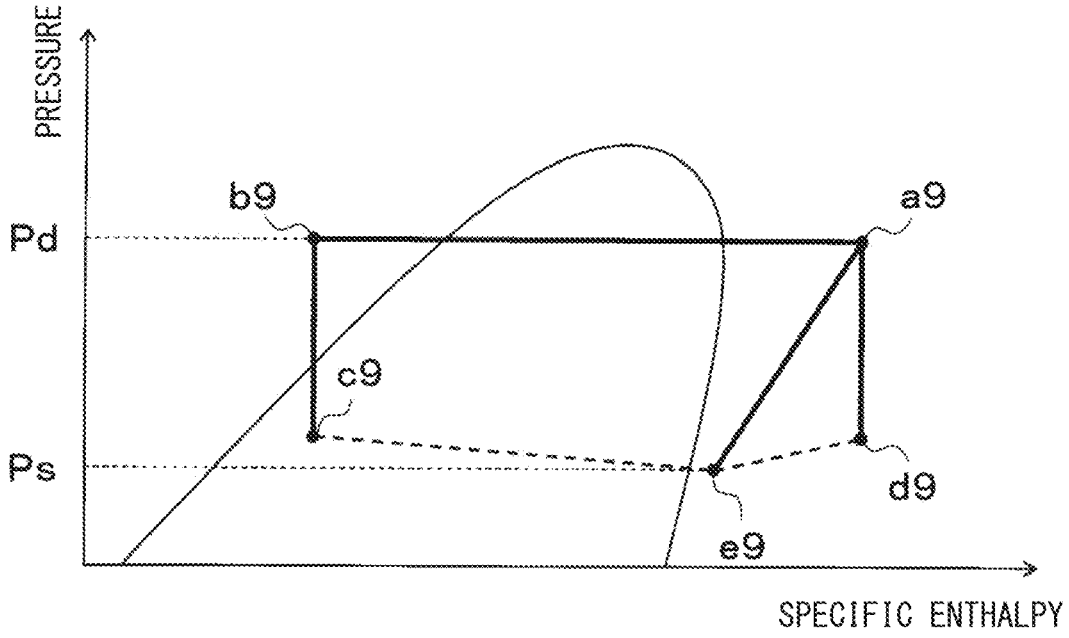
FIG. 9 is a Mollier chart showing a change in the state of the refrigerant in the single hot-gas air-heating mode of the heat pump cycle in the first embodiment.

Therefore, in the heat pump cycle 10 in the single hot-gas air-heating mode, the state of the refrigerant changes as illustrated in the Mollier chart of FIG. 9.

First, the flow of the discharge refrigerant (point a9 in FIG. 9) discharged from the compressor 11 is branched at the first three-way joint 12*a*. One refrigerant branched at the first three-wayjoint 12*a* flows into the water-refrigerant heat exchanger 13 and radiates heat to the high-temperature side heat medium (from point a9 to point b9 in FIG. 9). As a result, the high-temperature side heat medium is heated.

The refrigerant flowing out of the water-refrigerant heat exchanger 13 flows into the dehumidifying passage 21*a*. The refrigerant flown into the dehumidifying passage 21*a* flows into the cooling expansion valve 14*c* and is decompressed (from point b9 to point c9 in FIG. 9).

The refrigerant decompressed by the cooling expansion valve 14*c* flows into the chiller 20. In the hot-gas air-heating mode, since the low-temperature side pump 41 is stopped, the chiller 20 does not exchange heat between the refrigerant and the low-temperature side heat medium. The refrigerant flowing out of the chiller 20 flows into the other inlet port of the sixth three-way joint 12*f* via the fourth three-way joint 12*d* and the fifth three-way joint 12*e*.

The other refrigerant branched at the first three-way joint 12*a* flows into the bypass passage 21*c*. The refrigerant flowing into the bypass passage 21*c* is decompressed when the flow rate is regulated by the bypass-side flow-rate regulating valve 14*d* (from point a9 to point d9 in FIG. 9). The refrigerant decompressed by the bypass-side flow-rate regulating valve 14*d* flows into one inlet port of the sixth three-way joint 12*f*.

The refrigerant flowing out of the chiller 20 and the refrigerant flowing out of the bypass-side flow-rate regulating valve 14*d* are joined and mixed at the sixth three-way joint 12*f*. The refrigerant flowing out of the sixth three-way joint 12*f* is mixed when flowing through the suction-side passage 21*d* (point e9 in FIG. 9), and is sucked into the compressor 11.

As described above, in the heat pump cycle 10 in the hot-gas air-heating mode, refrigerants with different enthalpies, such as the low-enthalpy refrigerant flowing out of the chiller 20 (point c9 in FIG. 9) and the high-enthalpy refrigerant flowing out of the bypass passage 21*c* (point d9 in FIG. 9), are mixed and sucked into the compressor 11.

Therefore, in the heat pump cycle 10 in the hot-gas air-heating mode, the cooling expansion valve 14*c* serves as the heating-unit side decompression unit.

In the high-temperature side heat medium circuit 30 in the single hot-gas air-heating mode, the high-temperature side heat medium heated by the water-refrigerant heat exchanger 13 flows into the heater core 32 as in the single air-cooling mode.

In the interior air conditioning unit 50 in the single hot-gas air-heating mode, as in the single outside-air heat-absorption and air-heating mode, the ventilation air with a regulated temperature is blown into the vehicle cabin, so that the air in the vehicle cabin is heated.

Here, the single hot-gas air-heating mode is an operation mode performed when the outside air temperature Tam is extremely low. Therefore, when the refrigerant flowing out of the water-refrigerant heat exchanger 13 flows into the outside heat exchanger 15, the refrigerant may radiate heat to the outside air in the outside heat exchanger 15. When the refrigerant radiates heat to the outside air in the outside heat exchanger 15, the amount of heat by which the refrigerant radiates to the ventilation air in the water-refrigerant heat exchanger 13 decreases, and the heating performance of the ventilation air decreases accordingly.

In the single hot-gas air-heating mode of the present embodiment, since the refrigerant circuit is switched to the refrigerant circuit that does not allow the refrigerant flowing out of the water-refrigerant heat exchanger 13 to flow into the outside heat exchanger 15, it is possible to prevent the refrigerant from radiating heat to the outside air in the outside heat exchanger 15.

In the single hot-gas air-heating mode of the present embodiment, the throttle opening of the cooling expansion valve 14*c* is controlled in a manner that the degree of superheating SH of the suction refrigerant approaches the reference degree of superheating KSH. As a result, by increasing the refrigerant discharge performance of the compressor 11, the state of the suction refrigerant (point e9 in FIG. 9) can be the gas-phase refrigerant with the degree of superheating even if the amount of heat radiated from the discharge refrigerant to the high-temperature side heat medium in the water-refrigerant heat exchanger 13 is increased.

Therefore, in the single hot-gas air-heating mode, even when the outside air temperature Tam is extremely low, the heat generated by the workload of the compressor 11 can be effectively used to heat the ventilation air, and the air in the vehicle cabin can be heated.

(d-2) Cooling Hot-Gas Air-Heating Mode

In the cooling hot-gas air-heating mode, the control device 60 operates the low-temperature side pump 41 of the low-temperature side heat medium circuit 40 so as to exhibit the predetermined reference pumping performance, as compared with the single hot-gas air-heating mode. Therefore, in the heat pump cycle 10 in the cooling hot-gas air-heating mode, the refrigerant flowing into the chiller 20 absorbs heat from the low-temperature side heat medium. As a result, the low-temperature side heat medium is cooled. The other operations are similar to those in the single hot-gas air-heating mode.

Therefore, in the cooling hot-gas air-heating mode, the heat generated by the workload of the compressor 11 can be effectively used to heat the ventilation air, and the air in the vehicle cabin can be heated, as in the single hot-gas air-heating mode. In the low-temperature side heat medium circuit 40 in the cooling hot-gas air-heating mode, the low-temperature side heat medium cooled by the chiller 20 flows through the cooling water passage 70*a* of the battery 70. As a result, the battery 70 can be cooled.

(e) Hot-Gas Dehumidification and Air-Heating Mode

The hot-gas dehumidification and air-heating mode is an operation mode in which the air in the vehicle cabin is dehumidified and heated. In the control program, the hot-gas dehumidification and air-heating mode is selected when the outside air temperature Tam is a temperature in a predetermined low to medium temperature range (equal to or higher than 0° C. and lower than 10° C. in the present embodiment).

Examples of the hot-gas dehumidification and air-heating mode include a single hot-gas dehumidification and air-heating mode and a cooling hot-gas dehumidification and air-heating mode. The single hot-gas dehumidification and air-heating mode is an operation mode in which the air in the vehicle cabin is dehumidified and heated without cooling the battery 70. The cooling hot-gas dehumidification and air-heating mode is an operation mode in which the battery 70 is cooled, and at the same time, the air in the vehicle cabin is dehumidified and heated.

(e-1) Single Hot-Gas Dehumidification and Air-Heating Mode

In the heat pump cycle 10 in the single hot-gas dehumidification and air-heating mode, the control device 60 brings the air-heating expansion valve 14*a* into the fully closed state, brings the air-cooling expansion valve 14*b* into the throttled state, brings the cooling expansion valve 14*c* into the throttled state, and brings the bypass-side flow-rate regulating valve 14*d* into the throttled state. The control device 60 opens the dehumidifying on-off valve 22*a* and closes the air-heating on-off valve 22*b*.

Figure 10:
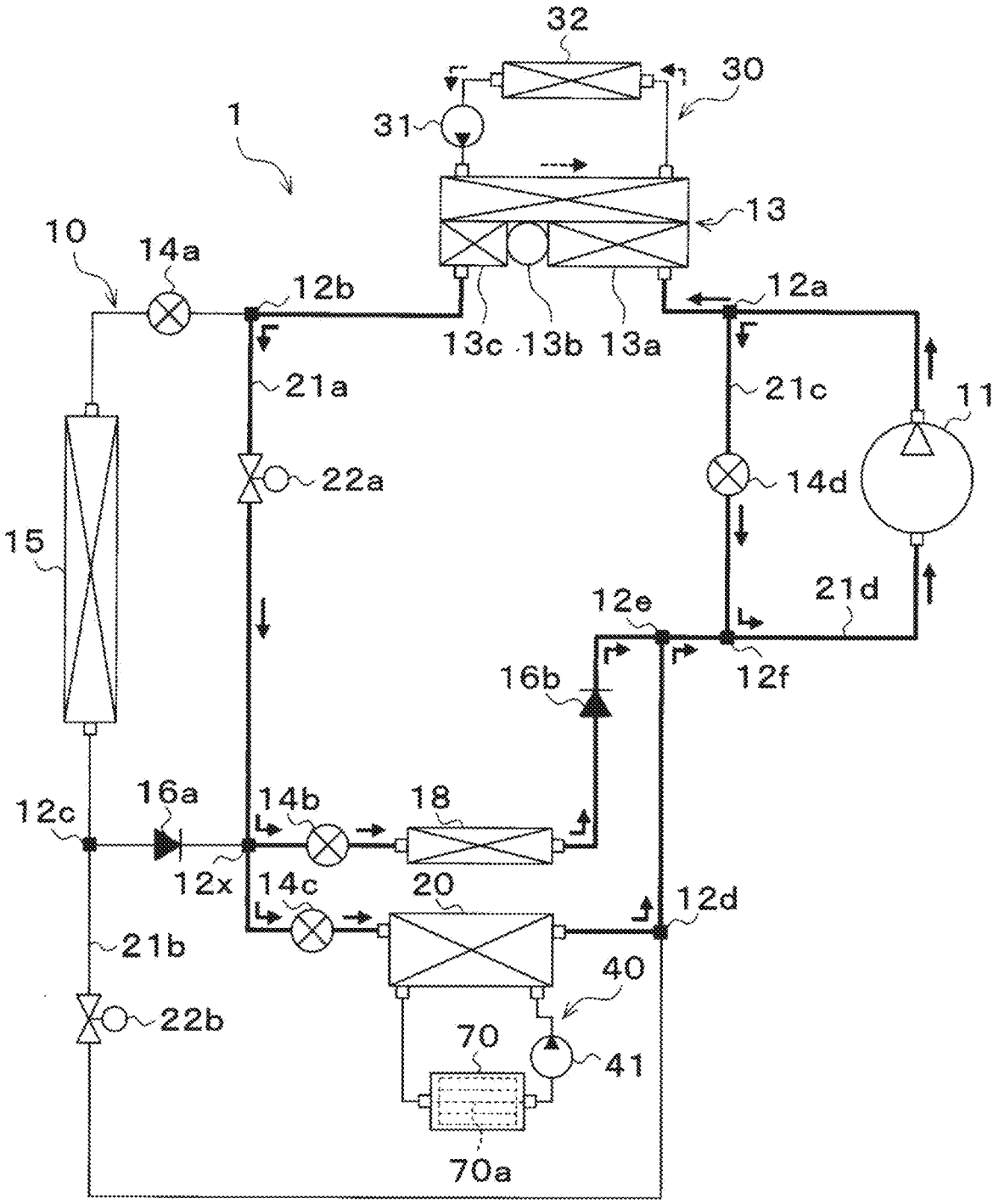
FIG. 10 is a schematic overall configuration diagram illustrating a flow of the refrigerant in a single hot-gas dehumidification and air-heating mode of the heat pump cycle in the first embodiment.

Therefore, in the heat pump cycle 10 in the single hot-gas dehumidification and air-heating mode, as indicated by the solid arrows in FIG. 10, the refrigerant discharged from the compressor 11 circulates similarly to the single hot-gas air-heating mode. At the same time, the refrigerant circuit is switched to a refrigerant circuit in which the refrigerant discharged from the compressor 11 circulates through the first three-way joint 12*a*, the water-refrigerant heat exchanger 13, the dehumidifying passage 21*a*, the air-cooling expansion valve 14*b* in the throttled state, the inside evaporator 18, the suction-side passage 21*d*, and the suction port of the compressor 11 in this order. That is, the refrigerant circuit is switched to a refrigerant circuit in which the inside evaporator 18 and the chiller 20 are connected in parallel to the refrigerant flow.

Furthermore, the control device 60 controls the refrigerant discharge performance of the compressor 11 in a manner that the suction refrigerant pressure Ps approaches a predetermined second target low pressure PSO2. The second target low pressure PSO2 is determined in a manner that the refrigerant evaporating temperature in the inside evaporator 18 is a temperature at which the ventilation air can be dehumidified without causing frosting on the inside evaporator 18.

In addition, the control device 60 controls the throttle opening of the bypass-side flow-rate regulating valve 14*d* in a manner that the discharge refrigerant pressure Pd approaches the target high pressure PDO, as in the hot-gas air-heating mode.

The control device 60 controls the throttle opening of the air-cooling expansion valve 14*b* to a predetermined throttle opening for the hot-gas dehumidification and air-heating mode.

The control device 60 also controls the throttle opening of the cooling expansion valve 14*c* in a manner that the degree of superheating SH of the suction refrigerant approaches the reference degree of superheating KSH.

In the high-temperature side heat medium circuit 30 in the single hot-gas dehumidification and air-heating mode, the control device 60 operates the high-temperature side pump 31 as in the single air-cooling mode.

In the low-temperature side heat medium circuit 40 in the single hot-gas dehumidification and air-heating mode, the control device 60 stops the low-temperature side pump 41.

In the interior air conditioning unit 50 in the single hot-gas dehumidification and air-heating mode, the control device 60 controls the ventilation performance of the inside blower 52 and the opening of the air mix door 54 as in the single air-cooling mode. The control device 60 appropriately controls the operations of other control target devices.

Figure 11:
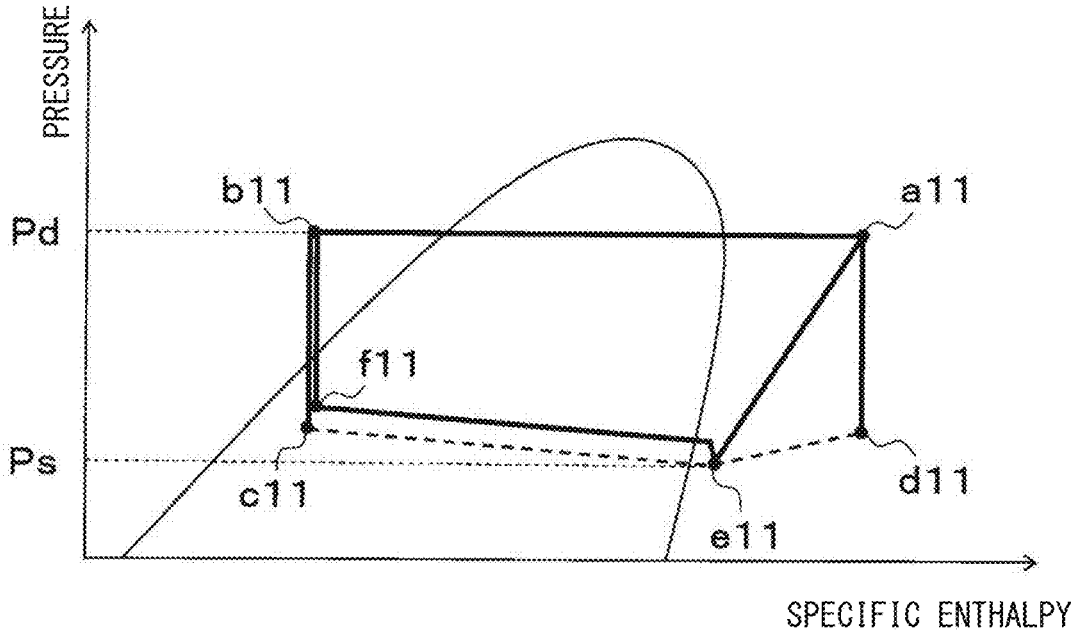
FIG. 11 is a Mollier chart showing a change in the state of the refrigerant in the single hot-gas dehumidification and air-heating mode of the heat pump cycle in the first embodiment.

Therefore, in the heat pump cycle 10 in the single hot-gas dehumidification and air-heating mode, the state of the refrigerant changes as illustrated in the Mollier chart of FIG. 11.

The flow of the discharge refrigerant (point a11 in FIG. 11) discharged from the compressor 11 is branched at the first three-way joint 12*a*. One refrigerant branched at the first three-wayjoint 12*a* flows into the water-refrigerant heat exchanger 13 and radiates heat to the high-temperature side heat medium (from point a11 to point b11 in FIG. 11). As a result, the high-temperature side heat medium is heated.

The refrigerant flowing out of the water-refrigerant heat exchanger 13 flows into the dehumidifying passage 21*a*. The flow of the refrigerant flowing into the dehumidifying passage 21*a* is branched at the four-way joint 12*x*. One refrigerant branched at the four-way joint 12*x* flows into the air-cooling expansion valve 14*b* and is decompressed (from point b11 to point f11 in FIG. 11).

The refrigerant decompressed by the air-cooling expansion valve 14*b* flows into the inside evaporator 18. The refrigerant flowing into the inside evaporator 18 exchanges heat with the ventilation air supplied by the inside blower 52 and evaporates. As a result, the ventilation air is cooled and dehumidified. The refrigerant flowing out of the inside evaporator 18 flows into one inlet port of the fifth three-way joint 12*e* via the second check valve 16*b*.

The other refrigerant branched at the four-way joint 12*x* flows into the cooling expansion valve 14*c* and is decompressed (from point b11 to point c11 in FIG. 11). The refrigerant decompressed by the cooling expansion valve 14*c* flows into the chiller 20. In the hot-gas dehumidification and air-heating mode, since the low-temperature side pump 41 is stopped, the chiller 20 does not exchange heat between the refrigerant and the low-temperature side heat medium. The refrigerant flowing out of the chiller 20 flows into the other inlet port of the fifth three-way joint 12*e*.

At the fifth three-way joint 12*e*, the flow of the refrigerant flowing out of the inside evaporator 18 and the flow of the refrigerant flowing out of the chiller 20 are joined. The refrigerant flowing out of the fifth three-way joint 12*e* flows into the other inlet port of the sixth three-way joint 12*f*.

The other refrigerant branched at the first three-way joint 12*a* flows into the bypass passage 21*c*. The refrigerant flowing into the bypass passage 21*c* is decompressed when the flow rate is regulated by the bypass-side flow-rate regulating valve 14*d* (from point a11 to point d11 in FIG. 11), as in the hot-gas air-heating mode. The refrigerant decompressed by the bypass-side flow-rate regulating valve 14*d* flows into one inlet port of the sixth three-way joint 12*f*.

The refrigerant flowing out of the fifth three-way joint 12*e* and the refrigerant flowing out of the bypass-side flow-rate regulating valve 14*d* are joined and mixed at the sixth three-way joint 12*f*. The refrigerant flowing out of the sixth three-way joint 12*f* is mixed when flowing through the suction-side passage 21*d* (point e11 in FIG. 11), and is sucked into the compressor 11.

Here, in FIG. 11, the pressure of the refrigerant decompressed by the cooling expansion valve 14*c* (point c11 in FIG. 11) is indicated by a value lower than the pressure of the refrigerant decompressed by the air-cooling expansion valve 14*b* (point f11 in FIG. 11), but it is not limited thereto. The pressure of the refrigerant decompressed by the cooling expansion valve 14*c* may be higher than or equal to the pressure of the refrigerant decompressed by the air-cooling expansion valve 14*b*.

As described above, in the heat pump cycle 10 in the hot-gas dehumidification and air-heating mode, the refrigerant circuit is switched to a refrigerant circuit in which refrigerants with different enthalpies, such as the low-enthalpy refrigerant flowing out of the chiller 20 (point c11 in FIG. 11), the high-enthalpy refrigerant flowing out of the bypass passage 21*c* (point d11 in FIG. 11), and the refrigerant flowing out of the inside evaporator 18, are mixed and sucked into the compressor 11.

Therefore, in the heat pump cycle 10 in the hot-gas dehumidification and air-heating mode, the air-cooling expansion valve 14*b* and the cooling expansion valve 14*c* serve as the heating-unit side decompression unit.

In the high-temperature side heat medium circuit 30 in the single hot-gas dehumidification and air-heating mode, the high-temperature side heat medium heated by the water-refrigerant heat exchanger 13 flows into the heater core 32 as in the single air-cooling mode. In the interior air conditioning unit 50 in the single hot-gas dehumidification and air-heating mode, the ventilation air with a regulated temperature is blown into the vehicle cabin, so that the air in the vehicle cabin is dehumidified and heated, as in the single series dehumidification and air-heating mode.

Here, the single hot-gas dehumidification and air-heating mode is an operation mode in which the ventilation air is cooled and dehumidified, and the dehumidified ventilation air is reheated to a desired temperature and blown into the vehicle cabin. For this reason, in the single hot-gas dehumidification and air-heating mode, it is necessary to regulate the workload of the compressor 11 in a manner that the temperature of the ventilation air can be reheated to a desired temperature by the heating unit without causing frosting on the inside evaporator 18.

In the single hot-gas dehumidification and air-heating mode of the present embodiment, the refrigerant with relatively high enthalpy flows into the sixth three-way joint 12*f* via the bypass passage 21*c*. Even when the refrigerant discharge performance of the compressor 11 is increased, it is possible to prevent the suction refrigerant pressure Ps from decreasing. As a result, it is possible to increase the amount of heat radiated from the discharge refrigerant to the high-temperature side heat medium in the water-refrigerant heat exchanger 13 without causing frosting on the inside evaporator 18.

Therefore, in the single hot-gas dehumidification and air-heating mode, the ventilation air can be heated with higher heating performance than in the series dehumidification and air-heating mode.

(e-2) Cooling Hot-Gas Dehumidification and Air-Heating Mode

In the cooling hot-gas dehumidification and air-heating mode, the control device 60 operates the low-temperature side pump 41 so as to exhibit the predetermined reference pumping performance, as compared with the single hot-gas dehumidification and air-heating mode. Therefore, in the heat pump cycle 10 in the cooling hot-gas dehumidification and air-heating mode, the refrigerant flowing into the chiller 20 absorbs heat from the low-temperature side heat medium. As a result, the low-temperature side heat medium is cooled. The other operations are similar to those in the single hot-gas dehumidification and air-heating mode.

Therefore, in the cooling hot-gas dehumidification and air-heating mode, the ventilation air is heated with higher heating performance than in the series dehumidification and air-heating mode, and the air in the vehicle cabin can be dehumidified and heated, as in the single hot-gas dehumidification and air-heating mode. In the low-temperature side heat medium circuit 40 in the cooling hot-gas dehumidification and air-heating mode, the low-temperature side heat medium cooled by the chiller 20 flows through the cooling water passage 70*a* of the battery 70. As a result, the battery 70 can be cooled.

(f) Hot-Gas Series Dehumidification and Air-Heating Mode

The hot-gas series dehumidification and air-heating mode is an operation mode in which the air in the vehicle cabin is dehumidified and heated. In the control program, the hot-gas series dehumidification and air-heating mode is selected when it is determined that the heating performance of the ventilation air in the water-refrigerant heat exchanger 13 is insufficient in the series dehumidification and air-heating mode.

Examples of the hot-gas series dehumidification and air-heating mode include a single hot-gas series dehumidification and air-heating mode and a cooling hot-gas series dehumidification and air-heating mode. The single hot-gas series dehumidification and air-heating mode is an operation mode in which the air in the vehicle cabin is dehumidified and heated without cooling the battery 70. The cooling hot-gas series dehumidification and air-heating mode is an operation mode in which the battery 70 is cooled, and at the same time, the air in the vehicle cabin is dehumidified and heated.

(f-1) Single Hot-Gas Series Dehumidification and Air-Heating Mode

In the heat pump cycle 10 in the single hot-gas series dehumidification and air-heating mode, the control device 60 brings the air-heating expansion valve 14*a* into the throttled state, brings the air-cooling expansion valve 14*b* into the throttled state, brings the cooling expansion valve 14*c* into the throttled state, and brings the bypass-side flow-rate regulating valve 14*d* into the throttled state. In addition, the control device 60 closes the dehumidifying on-off valve 22*a* and also closes the air-heating on-off valve 22*b*.

Figure 12:
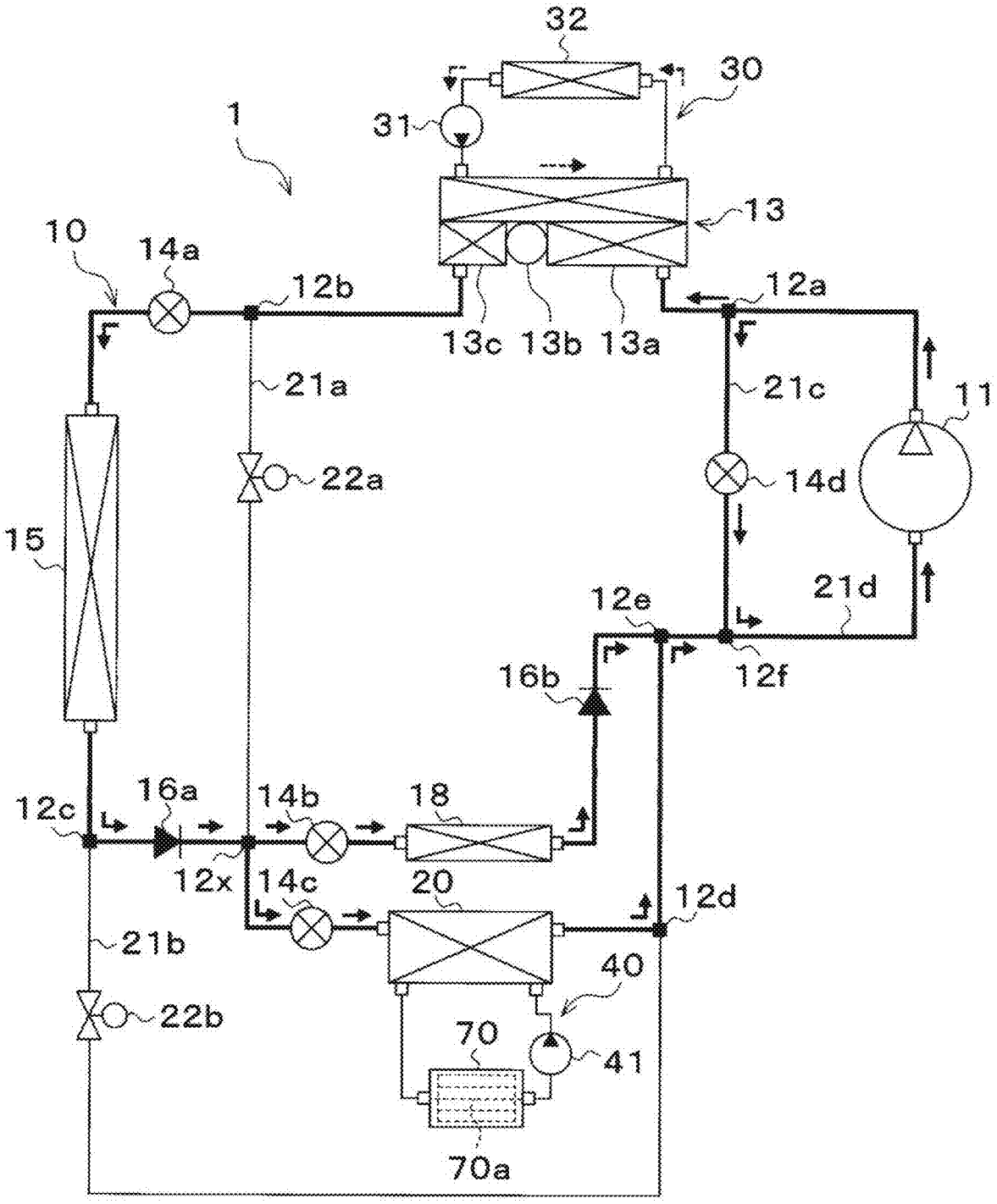
FIG. 12 is a schematic overall configuration diagram illustrating a flow of the refrigerant in a single hot-gas series dehumidification and air-heating mode of the heat pump cycle in the first embodiment.

Therefore, in the heat pump cycle 10 in the single hot-gas series dehumidification and air-heating mode, as indicated by the solid arrows in FIG. 12, the refrigerant discharged from the compressor 11 circulates similarly to the cooling series dehumidification and air-heating mode. At the same time, the refrigerant circuit is switched to a refrigerant circuit in which the refrigerant discharged from the compressor 11 circulates through the first three-way joint 12*a*, the bypass-side flow-rate regulating valve 14*d* in the throttled state, which is disposed in the bypass passage 21*c*, the sixth three-way joint 12*f*, the suction-side passage 21*d*, and the suction port of the compressor 11 in this order.

Furthermore, the control device 60 controls the refrigerant discharge performance of the compressor 11 in a manner that the suction refrigerant pressure Ps approaches the predetermined second target low pressure PSO2, as in the hot-gas dehumidification and air-heating mode.

In addition, the control device 60 controls the throttle opening of the bypass-side flow-rate regulating valve 14*d* in a manner that the discharge refrigerant pressure Pd approaches the target high pressure PDO, as in the hot-gas air-heating mode.

The control device 60 controls the throttle opening of the air-heating expansion valve 14*a* and the throttle opening of the air-cooling expansion valve 14*b* to a predetermined throttle opening for the hot-gas series dehumidification and air-heating mode.

The control device 60 also controls the throttle opening of the cooling expansion valve 14*c* in a manner that the degree of superheating SH of the suction refrigerant approaches the reference degree of superheating KSH, as in the hot-gas dehumidification and air-heating mode.

In the high-temperature side heat medium circuit 30 in the single hot-gas dehumidification and air-heating mode, the control device 60 operates the high-temperature side pump 31 as in the single air-cooling mode.

In the low-temperature side heat medium circuit 40 in the single hot-gas dehumidification and air-heating mode, the control device 60 stops the low-temperature side pump 41.

In the interior air conditioning unit 50 in the single hot-gas dehumidification and air-heating mode, the control device 60 controls the ventilation performance of the inside blower 52 and the opening of the air mix door 54 as in the single air-cooling mode. The control device 60 appropriately controls the operations of other control target devices.

Figure 13:
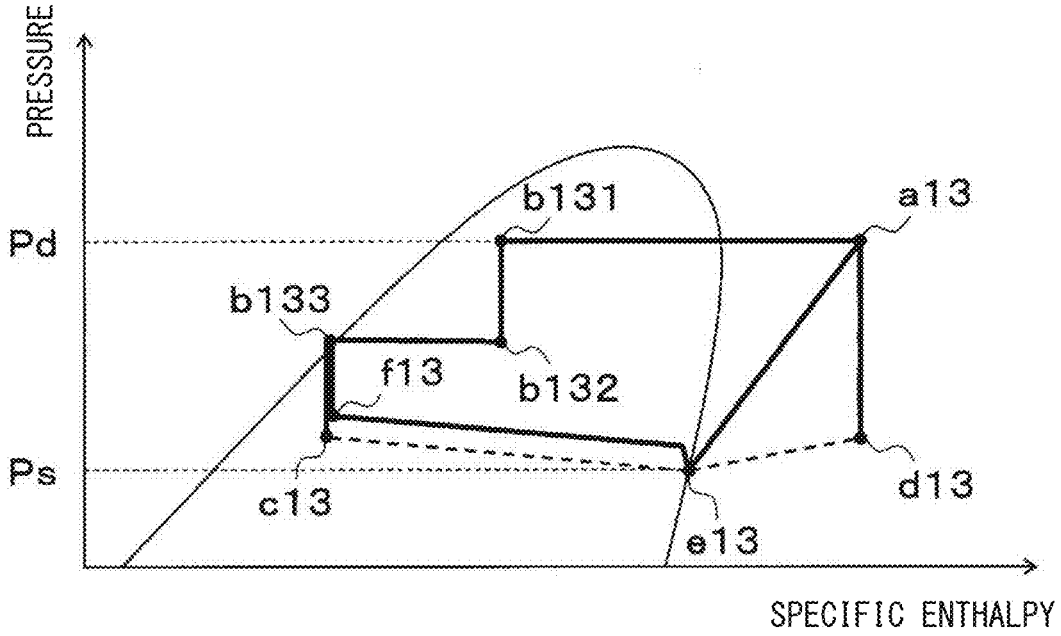
FIG. 13 is a Mollier chart showing a change in the state of the refrigerant in the single hot-gas series dehumidification and air-heating mode of the heat pump cycle in the first embodiment.

Therefore, in the heat pump cycle 10 in the single hot-gas series dehumidification and air-heating mode, the state of the refrigerant changes as illustrated in the Mollier chart of FIG. 13. FIG. 13 illustrates an example in which the saturation temperature of the refrigerant in the outside heat exchanger 15 is higher than the outside air temperature Tam.

The flow of the discharge refrigerant (point a13 in FIG. 13) discharged from the compressor 11 is branched at the first three-way joint 12*a*. One refrigerant branched at the first three-wayjoint 12*a* flows into the water-refrigerant heat exchanger 13 and radiates heat to the high-temperature side heat medium (from point a13 to point b131 in FIG. 13). As a result, the high-temperature side heat medium is heated.

The refrigerant flowing out of the water-refrigerant heat exchanger 13 flows into the air-heating expansion valve 14*a* and is decompressed (from point b131 to point b132 in FIG. 13). The refrigerant decompressed by the air-heating expansion valve 14*a* flows into the outside heat exchanger 15. In the example illustrated in FIG. 13, the refrigerant flowing into the outside heat exchanger 15 exchanges heat with the outside air to reduce the enthalpy (from point b132 to point b133 in FIG. 13).

The flow of the refrigerant flowing from the outside heat exchanger 15 is branched at the four-way joint 12*x*. One refrigerant branched at the four-way joint 12*x* flows into the air-cooling expansion valve 14*b* and is decompressed (from point b133 to point f13 in FIG. 13).

The refrigerant decompressed by the air-cooling expansion valve 14*b* flows into the inside evaporator 18, exchanges heat with the ventilation air supplied by the inside blower 52, and evaporates (from point f13 to point e13 in FIG. 13), as in the hot-gas dehumidification and air-heating mode. As a result, the ventilation air is cooled and dehumidified. The refrigerant flowing out of the inside evaporator 18 flows into one inlet port of the fifth three-way joint 12*e* via the second check valve 16*b*.

The other refrigerant branched at the four-way joint 12*x* flows into the cooling expansion valve 14*c* and is decompressed (from point b133 to point c13 in FIG. 13), as in the hot-gas air-heating mode. The refrigerant decompressed by the cooling expansion valve 14*c* flows into the chiller 20. The refrigerant flowing out of the chiller 20 flows into the other inlet port of the fifth three-way joint 12*e*.

The flow of the refrigerant flowing out of the inside evaporator 18 and the flow of the refrigerant flowing out of the chiller 20 are joined at the fifth three-way joint 12*e*, as in the hot-gas air-heating mode. The refrigerant flowing out of the fifth three-way joint 12*e* flows into the other inlet port of the sixth three-way joint 12*f*.

The other refrigerant branched at the first three-way joint 12*a* flows into the bypass passage 21*c*. The refrigerant flowing into the bypass passage 21*c* is decompressed when the flow rate is regulated by the bypass-side flow-rate regulating valve 14*d* (from point a13 to point d13 in FIG. 13), as in the hot-gas air-heating mode. The refrigerant decompressed by the bypass-side flow-rate regulating valve 14*d* flows into one inlet port of the sixth three-way joint 12*f*.

The refrigerant flowing out of the fifth three-way joint 12*e* and the refrigerant flowing out of the bypass-side flow-rate regulating valve 14*d* are joined and mixed at the sixth three-way joint 12*f*, as in the hot-gas dehumidification and air-heating mode. The refrigerant flowing out of the sixth three-way joint 12*f* is mixed when flowing through the suction-side passage 21*d* (point e13 in FIG. 13), and is sucked into the compressor 11.

Here, in FIG. 13, the pressure of the refrigerant decompressed by the cooling expansion valve 14*c* (point c13 in FIG. 13) is indicated by a value lower than the pressure of the refrigerant decompressed by the air-cooling expansion valve 14*b* (point f13 in FIG. 13), but it is not limited thereto. The pressure of the refrigerant decompressed by the cooling expansion valve 14*c* may be higher than or equal to the pressure of the refrigerant decompressed by the air-cooling expansion valve 14*b*.

As described above, in the heat pump cycle 10 in the hot-gas series dehumidification and air-heating mode, the refrigerant circuit is switched to a refrigerant circuit in which refrigerants with different enthalpies, such as the low-enthalpy refrigerant flowing out of the chiller 20 (point c13 in FIG. 13), the high-enthalpy refrigerant flowing out of the bypass passage 21*c* (point d13 in FIG. 13), and the refrigerant flowing out of the inside evaporator 18, are mixed and sucked into the compressor 11.

Therefore, in the heat pump cycle 10 in the hot-gas series dehumidification and air-heating mode, the air-heating expansion valve 14*a*, the air-cooling expansion valve 14*b*, and the cooling expansion valve 14*c* serve as the heating-unit side decompression unit.

In the high-temperature side heat medium circuit 30 in the single hot-gas series dehumidification and air-heating mode, the high-temperature side heat medium heated by the water-refrigerant heat exchanger 13 flows into the heater core 32 as in the single air-cooling mode.

In the interior air conditioning unit 50 in the single hot-gas series dehumidification and air-heating mode, the ventilation air with a regulated temperature is blown into the vehicle cabin, so that the air in the vehicle cabin is dehumidified and heated, as in the single series dehumidification and air-heating mode.

In the hot-gas series dehumidification and air-heating mode, it is necessary to regulate the refrigerant discharge performance of the compressor 11 in a manner that the heating unit can reheat the ventilation air to a desired temperature without causing frosting on the inside evaporator 18, as in the hot-gas dehumidification and air-heating mode.

In the single hot-gas series dehumidification and air-heating mode of the present embodiment, the refrigerant with relatively high enthalpy flows into the sixth three-way joint 12*f* via the bypass passage 21*c*. Therefore, even when the refrigerant discharge performance of the compressor 11 is increased, it is possible to increase the amount of heat radiated from the discharge refrigerant to the ventilation air in the water-refrigerant heat exchanger 13 without causing frosting on the inside evaporator 18, as in the single hot-gas series dehumidification and air-heating mode.

As a result, in the single hot-gas series dehumidification and air-heating mode, the ventilation air can be heated with higher heating performance than in the series dehumidification and air-heating mode.

(f-2) Cooling Hot-Gas Series Dehumidification and Air-Heating Mode

In the cooling hot-gas series dehumidification and air-heating mode, the control device 60 operates the low-temperature side pump 41 so as to exhibit the predetermined reference pumping performance, as compared with the single hot-gas series dehumidification and air-heating mode. Therefore, in the heat pump cycle 10 in the cooling hot-gas series dehumidification and air-heating mode, the refrigerant flowing into the chiller 20 absorbs heat from the low-temperature side heat medium. As a result, the low-temperature side heat medium is cooled. The other operations are similar to those in the single hot-gas series dehumidification and air-heating mode.

Therefore, in the cooling hot-gas series dehumidification and air-heating mode, the ventilation air is heated with higher heating performance than in the series dehumidification and air-heating mode, and the air in the vehicle cabin can be dehumidified and heated, as in the single hot-gas series dehumidification and air-heating mode. In the low-temperature side heat medium circuit 40 in the cooling hot-gas dehumidification and air-heating mode, the low-temperature side heat medium cooled by the chiller 20 flows through the cooling water passage 70*a* of the battery 70. As a result, the battery 70 can be cooled.

As described above, in the vehicle air conditioner 1 of the present embodiment, by switching the operation mode, comfortable air conditioning in the vehicle cabin and appropriate temperature regulation of the battery 70, which is an in-vehicle device, can be performed.

In the vehicle air conditioner 1 of the present embodiment, in the operation modes of (d) hot-gas air-heating mode, (e) hot-gas dehumidification and air-heating mode, and (f) hot-gas series dehumidification and air-heating mode, the refrigerant circuit is switched to a refrigerant circuit in which refrigerants with different enthalpies are mixed at the sixth three-way joint 12*f*, which is a joining portion, and sucked into the compressor 11.

In a heat pump cycle device in which refrigerants with different enthalpies are mixed and sucked into a compressor, insufficient mixing of the refrigerants may cause the liquid compression of the compressor. This is because if the refrigerants are mixed insufficiently and a temperature distribution is generated in a suction refrigerant, the liquid-phase refrigerant may be unevenly distributed in the suction refrigerant. If the compressor sucks the liquid-phase refrigerant that is unevenly distributed, liquid compression may occur.

On the other hand, in the vehicle air conditioner 1 of the present embodiment, since the suction-side flow path length L1 is equal to or longer than the relaxation distance Lv, the suction refrigerant can be made homogeneous. Therefore, uneven distribution of the liquid-phase refrigerant in the suction refrigerant can be prevented, so that the liquid compression of the compressor 11 can be prevented. That is, it is possible to protect the compressor 11.

Furthermore, the suction-side flow path length L1 can be easily regulated by regulating the length of the suction-side passage 21*d*. Therefore, the productivity of the vehicle air conditioner 1 is less likely to deteriorate in order to make the suction refrigerant sufficiently homogeneous.

As a result, according to the vehicle air conditioner 1 of the present embodiment, even in the heat pump cycle device in which refrigerants with different enthalpies are mixed and sucked into the compressor, the compressor 11 can be protected without deteriorating productivity. In other words, in the heat pump cycle device in which refrigerants with different enthalpies are mixed and sucked into the compressor, the compressor can be protected and at the same time, productivity can be prevented from deteriorating.

In the vehicle air conditioner 1 of the present embodiment, the detection-unit flow path length L2 is equal to or longer than the relaxation distance Lv. As a result, the refrigerant to be detected by the suction refrigerant temperature sensor 62*f* can be made homogeneous. The control device 60 can accurately determine the degree of superheating SH of the suction refrigerant and appropriately control the operations of various control target devices. As a result, the compressor 11 can be more reliably protected.

In the vehicle air conditioner 1 of the present embodiment, the refrigerant passage in the sixth three-way joint 12*f*, which is a joining portion, is formed in a manner that the flow direction of the main flow of the heating-unit side refrigerant immediately before joining and the flow direction of the main flow of the bypass-side refrigerant immediately before joining cross each other. Accordingly, the average flow velocity Uv of the droplets and the gas-phase refrigerant at the junction MX of the sixth three-way joint 12*f* can be reduced. As a result, the relaxation distance Lv can be reduced as shown in Formula F15.

Second Embodiment

The present embodiment will describe an example in which the arrangement of the suction refrigerant temperature sensor 62*f* is changed in the vehicle air conditioner 1 of the first embodiment.

Figure 14:
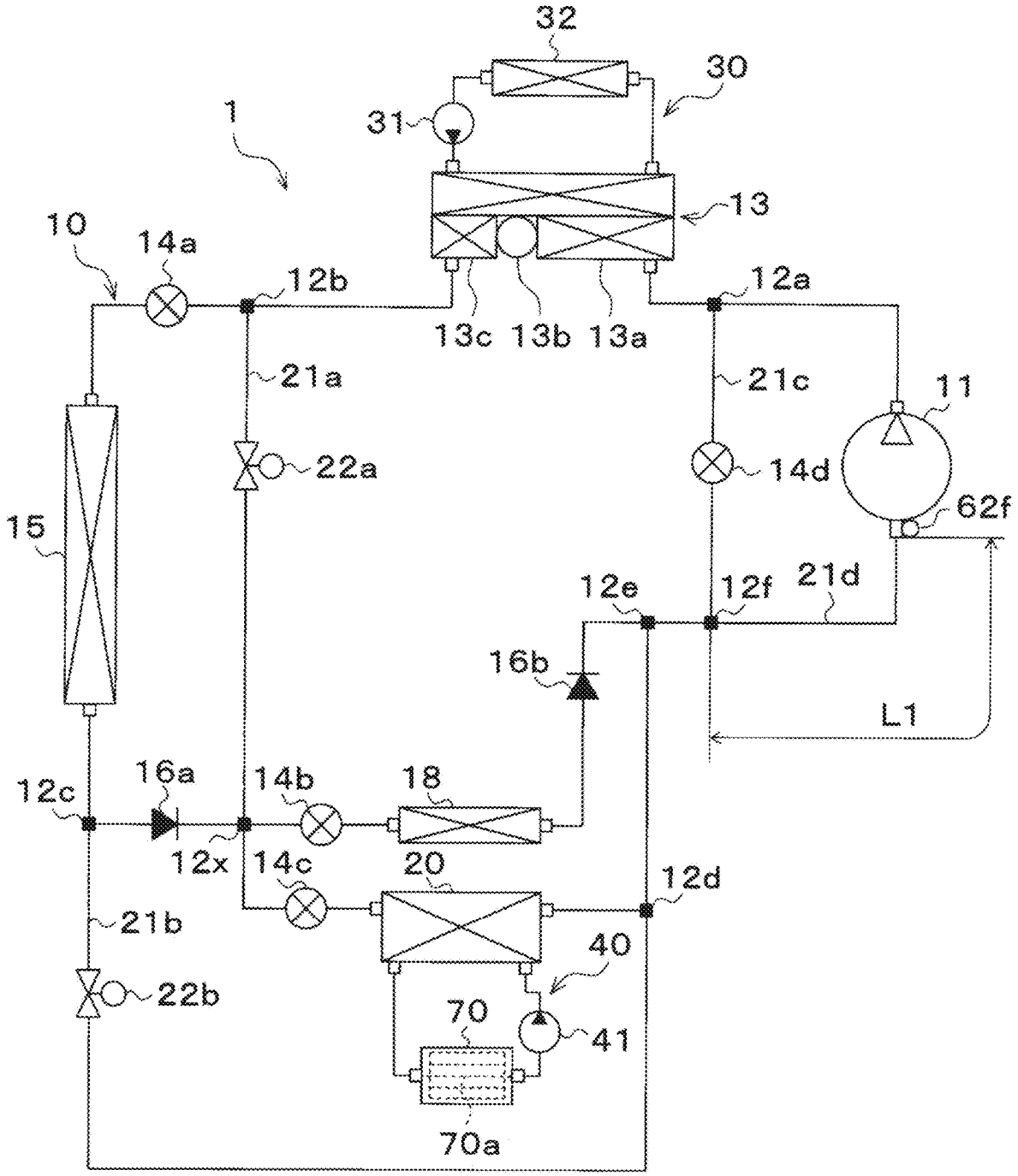
FIG. 14 is a schematic overall configuration diagram of a vehicle air conditioner of a second embodiment.

More specifically, the compressor 11 of the present embodiment has a housing forming a suction port and the like. An attachment portion of the suction refrigerant temperature sensor 62*f* for detecting the temperature of a suction refrigerant is formed in the housing. As a result, in the vehicle air conditioner 1 of the present embodiment, as illustrated in FIG. 14, the suction refrigerant temperature sensor 62*f* is disposed at the suction port of the compressor 11.

Other configurations and operations are similar to those in the first embodiment. Therefore, effects similar to those of the first embodiment can be obtained.

Furthermore, in the vehicle air conditioner 1 of the present embodiment, the suction-side flow path length L1 is substantially equal to the detection-unit flow path length L2. Therefore, as compared with the vehicle air conditioner 1 described in the first embodiment, the suction-side flow path length L1 can be reduced to further prevent deterioration in productivity.

Third Embodiment

The present embodiment will describe an example in which an accumulator 23 is added to the heat pump cycle 10 in the vehicle air conditioner 1 of the first embodiment.

Figure 15:
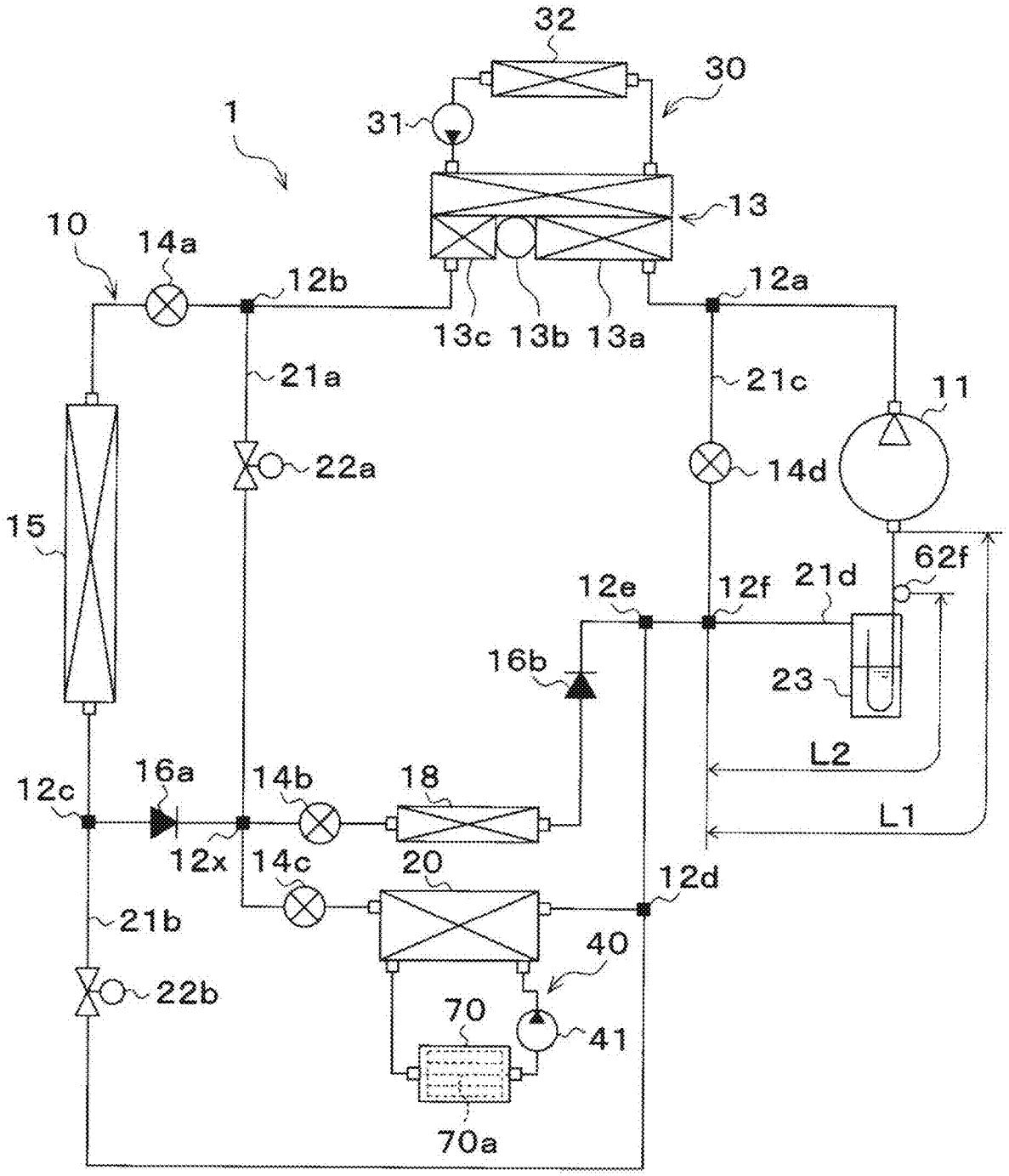
FIG. 15 is a schematic overall configuration diagram of a vehicle air conditioner of a third embodiment.

More specifically, as illustrated in FIG. 15, the accumulator 23 is disposed in the suction-side passage 21*d*. The accumulator 23 is a low-pressure side gas-liquid separating unit that separates the refrigerant flowing through the suction-side passage 21*d* into gas and liquid and stores the separated liquid-phase refrigerant as an excess refrigerant in the cycle. The suction port side of the compressor 11 is connected to a gas-phase refrigerant outlet port of the accumulator 23. The suction refrigerant temperature sensor 62*f* is disposed on the downstream side in the refrigerant flow of the gas-phase refrigerant outlet port of the accumulator 23.

Other configurations and operations are similar to those in the first embodiment. Therefore, effects similar to those of the first embodiment can be obtained.

Furthermore, in the vehicle air conditioner 1 of the present embodiment, the accumulator 23 forms a portion with an enlarged passage sectional area in the suction-side passage 21*d*. Accordingly, the average flow velocity Uv of the droplets and the gas-phase refrigerant at the junction MX of the sixth three-way joint 12*f* can be reduced. As a result, the relaxation distance Lv can be reduced as shown in Formula F15 described in the first embodiment.

Therefore, by setting the suction-side flow path length L1 and the detection-unit flow path length L2 to values similar to those in the first embodiment, it is possible to more reliably protect the compressor 11.

When the accumulator 23 is disposed in the suction-side passage 21*d*, there is a possibility that the liquid-phase refrigerant stored in the accumulator 23 may be wound up and the liquid level of the accumulator 23 may become unstable, that is, so-called liquid level loss may occur. When liquid level loss occurs in the accumulator 23, the dryness of the suction refrigerant may decrease, or the return amount of the refrigerant oil to the compressor 11 may be insufficient.

The present inventors have confirmed that, by setting the suction-side flow path length L1 and the detection-unit flow path length L2 to be equal to or longer than the relaxation distance Lv, the degree of superheating SH and the dryness Rx of the suction refrigerant can be appropriately regulated, and the liquid compression of the compressor 11 can be reliably prevented.

Fourth Embodiment

The present embodiment will describe an example in which the arrangement of the sixth three-way joint 12*f*, which is a joining portion, is changed in the vehicle air conditioner 1 of the first embodiment.

Figure 16:
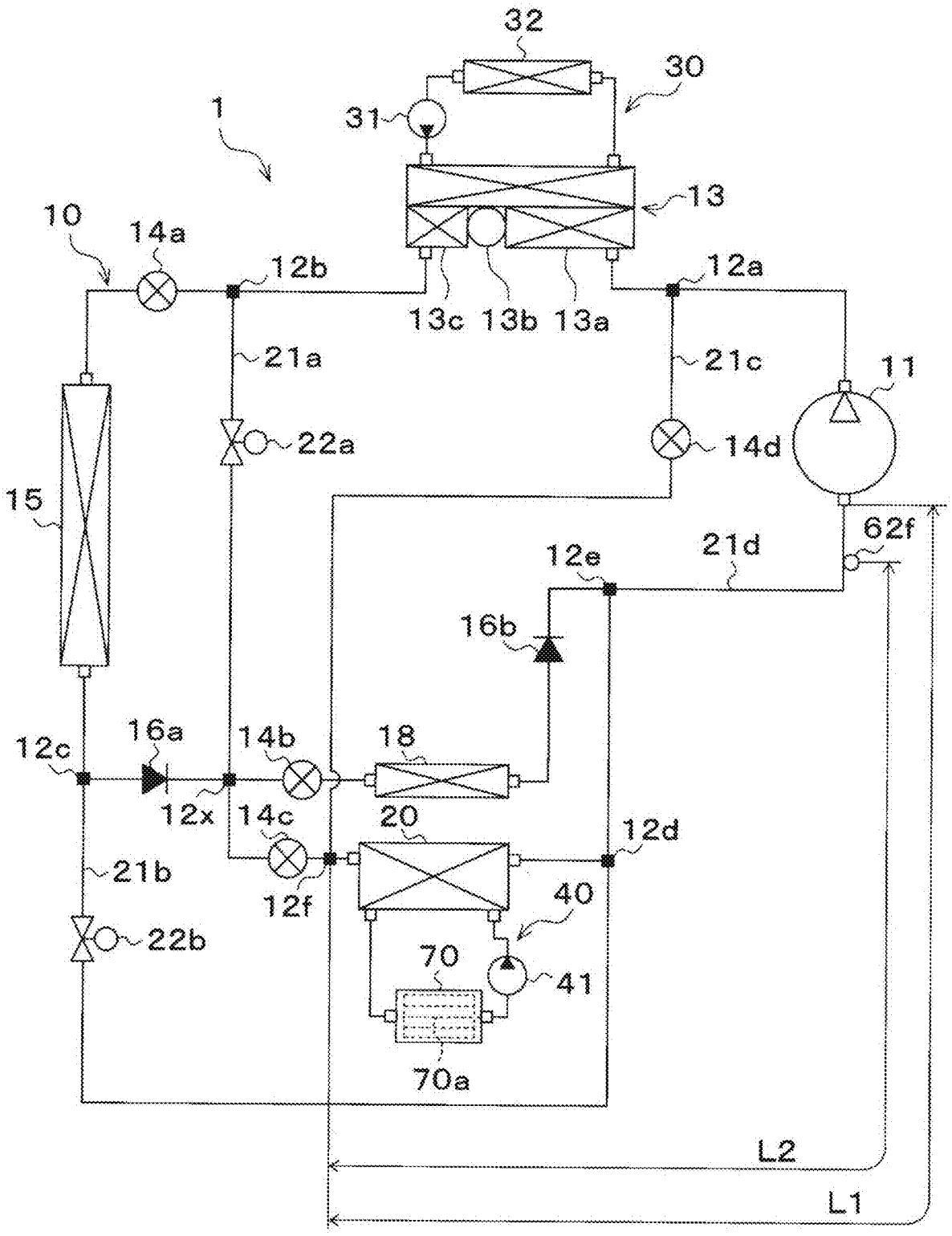
FIG. 16 is a schematic overall configuration diagram of a vehicle air conditioner of a fourth embodiment.

More specifically, as illustrated in FIG. 16, the sixth three-way joint 12*f* of the present embodiment is disposed in the refrigerant flow path from the outlet port of the cooling expansion valve 14*c* to the inlet port of the refrigerant passage in the chiller 20. Therefore, the chiller 20 of the present embodiment is a heat exchanger that is disposed in the suction-side passage 21*d* and exchanges heat between the refrigerant and the low-temperature side heat medium.

The suction refrigerant temperature sensor 62*f* is disposed on the downstream side in the refrigerant flow of the outlet port of the refrigerant passage in the chiller 20.

Other configurations and operations are similar to those in the first embodiment. Therefore, effects similar to those of the first embodiment can be obtained.

Furthermore, in the vehicle air conditioner 1 of the present embodiment, since the chiller 20 is disposed in the suction-side passage 21*d*, the chiller 20 can form a portion with an enlarged passage sectional area in a part of the suction-side passage 21*d*. Accordingly, the average flow velocity Uv of the droplets and the gas-phase refrigerant at the junction MX of the sixth three-way joint 12*f* can be reduced and thus the relaxation distance Lv can be reduced, as in the third embodiment.

Therefore, by setting the suction-side flow path length L1 and the detection-unit flow path length L2 to values similar to those in the first embodiment, it is possible to more reliably protect the compressor 11.

Fifth Embodiment

In the present embodiment, the heat pump cycle device according to the present disclosure is applied to a vehicle air conditioner 1*a*. The vehicle air conditioner 1*a* is an air conditioner with an in-vehicle device temperature regulation function similar to the vehicle air conditioner 1 described in the first embodiment. The vehicle air conditioner 1*a* includes a heat pump cycle 10*a*.

Figure 17:
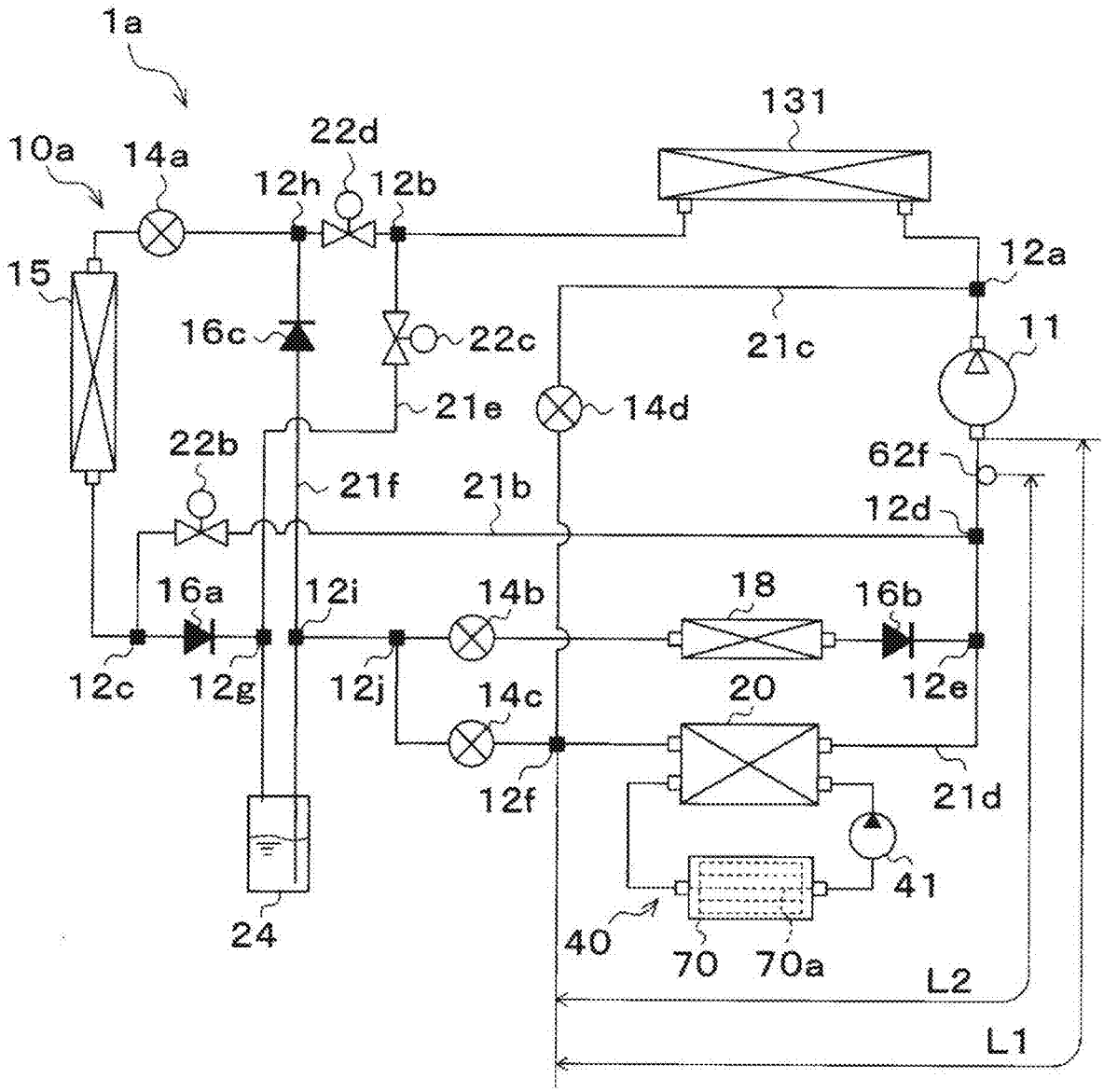
FIG. 17 is a schematic overall configuration diagram of a vehicle air conditioner of a fifth embodiment.

As illustrated in FIG. 17, the heat pump cycle 10*a* includes an inside condenser 131 and a receiver 24 instead of the water-refrigerant heat exchanger 13 and the high-temperature side heat medium circuit 30 as compared with the heat pump cycle 10 described in the first embodiment.

In the heat pump cycle 10*a*, an inlet port side of a refrigerant passage in the inside condenser 131 is connected to one outlet port of the first three-way joint 12*a*. The inside condenser 131 is disposed in the air conditioning casing 51 of the interior air conditioning unit 50 similarly to the heater core 32 described in the first embodiment.

The inside condenser 131 is a heating heat exchanger that exchanges heat between the high-pressure refrigerant discharged from the compressor 11 and ventilation air passing through the inside evaporator 18 to heat ventilation air. Therefore, the inside condenser 131 is a heating unit that heats the ventilation air as a heating object using one discharge refrigerant branched at the first three-way joint 12*a* as a heat source.

In the heat pump cycle 10*a*, an inlet port side of the receiver 24 is connected to the other outlet port of the second three-way joint 12*b*. The refrigerant passage from the other outlet port of the second three-way joint 12*b* to an inlet port of the receiver 24 is an inlet-port side passage 21*e*. A first inlet-port side on-off valve 22*c* and a seventh three-way joint 12*g* are arranged in the inlet-port side passage 21*e*.

The receiver 24 is a high-pressure side gas-liquid separating unit that separates a refrigerant flowing into the receiver into gas and liquid and stores the separated liquid-phase refrigerant as an excess refrigerant in the cycle. The receiver 24 causes the separated liquid-phase refrigerant to flow downstream from a liquid-phase refrigerant outlet port.

The first inlet-port side on-off valve 22*c* is an on-off valve that opens and closes the inlet-port side passage 21*e*. More specifically, the first inlet-port side on-off valve 22*c* opens and closes a refrigerant passage from the other outlet port of the second three-way joint 12*b* to one inlet port of the seventh three-way joint 12*g* in the inlet-port side passage 21*e*. The first inlet-port side on-off valve 22*c* is a refrigerant circuit switching unit.

One inlet port side of an eighth three-way joint 12*h* is connected to one outlet port of the second three-way joint 12*b*. A second inlet-port side on-off valve 22*d* is disposed in a refrigerant passage from one outlet port of the second three-way joint 12*b* to one inlet port of the eighth three-way joint 12*h*. The second inlet-port side on-off valve 22*d* opens and closes the refrigerant passage from one outlet port of the second three-way joint 12*b* to one inlet port of the eighth three-way joint 12*h*. The second inlet-port side on-off valve 22*d* is the refrigerant circuit switching unit.

An inlet port side of the air-heating expansion valve 14*a* is connected to an outlet port of the eighth three-way joint 12*h*. The other inlet port of the seventh three-way joint 12*g* disposed in the inlet-port side passage 21*e* is connected to one outlet port of the third three-way joint 12*c* connected to the outlet port side of the outside heat exchanger 15 via the first check valve 16*a*.

The other inlet port side of the eighth three-way joint 12*h* is connected to a liquid-phase refrigerant outlet port of the receiver 24. The refrigerant passage from the outlet port of the receiver 24 to the other inlet port of the eighth three-way joint 12*h* is an outlet-port side passage 21*f*. A ninth three-way joint 12*i* and a third check valve 16*c* are arranged in the outlet-port side passage 21*f*.

The third check valve 16*c* allows the refrigerant to flow from the ninth three-way joint 12*i* side to the eighth three-way joint 12*h* side, and prohibits the refrigerant from flowing from the eighth three-way joint 12*h* side to the ninth three-way joint 12*i* side.

An inlet port side of a tenth three-way joint 12*j* is connected to the other outlet port of the ninth three-way joint 12*i*. A refrigerant inlet port side of the inside evaporator 18 is connected to one outlet port of the tenth three-way joint 12*j* via the air-cooling expansion valve 14*b*. An inlet port side of a refrigerant passage in the chiller 20 is connected to the other outlet port of the tenth three-way joint 12*j* via the cooling expansion valve 14*c*.

In the heat pump cycle 10*a*, a suction port side of the compressor 11 is connected to the outlet port of the fourth three-way joint 12*d*.

In the heat pump cycle 10*a*, the sixth three-way joint 12*f* is disposed in the refrigerant flow path from the outlet port of the cooling expansion valve 14*c* to the inlet port of the refrigerant passage in the chiller 20 as in the fourth embodiment. Therefore, the chiller 20 of the present embodiment is a heat exchanger that is disposed in the suction-side passage 21*d* and exchanges heat between the refrigerant and the low-temperature side heat medium. The suction refrigerant temperature sensor 62*f* is disposed on the downstream side in the refrigerant flow of the outlet port of the refrigerant passage in the chiller 20.

Other configurations of the vehicle air conditioner 1*a* are similar to those of the vehicle air conditioner 1 described in the first embodiment. That is, also in the vehicle air conditioner 1*a* of the present embodiment, the suction-side flow path length L1 is equal to or longer than the relaxation distance Lv. In addition, the detection-unit flow path length L2 is equal to or longer than the relaxation distance Lv.

Next, the operation of the vehicle air conditioner 1*a* of the present embodiment in the above configuration will be described. In the vehicle air conditioner 1*a* of the present embodiment, various operation modes are switched in order to perform air conditioning in the vehicle cabin and temperature regulation of the battery 70, as in the first embodiment. Hereinafter, the detailed operation of each operation mode will be described.

(a-1) Single Air-Cooling Mode

In the heat pump cycle 10*a* in the single air-cooling mode, the control device 60 brings the air-heating expansion valve 14*a* into a fully open state, brings the air-cooling expansion valve 14*b* into a throttled state, brings the cooling expansion valve 14*c* into a fully closed state, and brings the bypass-side flow-rate regulating valve 14*d* into the fully closed state. In addition, the control device 60 closes the air-heating on-off valve 22*b*, closes the first inlet-port side on-off valve 22*c*, and opens the second inlet-port side on-off valve 22*d*.

Therefore, in the heat pump cycle 10*a* in the single air-cooling mode, the refrigerant circuit is switched to a refrigerant circuit in which the refrigerant discharged from the compressor 11 circulates through the inside condenser 131, the air-heating expansion valve 14*a* in the fully open state, the outside heat exchanger 15, the receiver 24, the air-cooling expansion valve 14*b* in the throttled state, the inside evaporator 18, and the suction port of the compressor 11 in this order. The control device 60 appropriately controls the operations of other control target devices.

Therefore, in the heat pump cycle 10*a* in the single air-cooling mode, a vapor compression refrigeration cycle is configured in which the inside condenser 131 and the outside heat exchanger 15 function as condensers, and the inside evaporator 18 function as an evaporator.

In the interior air conditioning unit 50 in the single air-cooling mode, the ventilation air with a regulated temperature is blown into the vehicle cabin, so that the air in the vehicle cabin is cooled, as in the first embodiment.

(a-2) Cooling and Air-Cooling Mode

In the heat pump cycle 10*a* in the cooling and air-cooling mode, the control device 60 brings the cooling expansion valve 14*c* into the throttled state as compared with the single air-cooling mode.

Therefore, in the heat pump cycle 10*a* in the cooling and air-cooling mode, the refrigerant discharged from the compressor 11 circulates similarly to the single air-cooling mode. At the same time, the refrigerant circuit is switched to a refrigerant circuit in which the refrigerant discharged from the compressor 11 circulates through the inside condenser 131, the air-heating expansion valve 14*a* in the fully open state, the outside heat exchanger 15, the receiver 24, the cooling expansion valve 14*c* in the throttled state, the chiller 20, and the suction port of the compressor 11 in this order. That is, the refrigerant circuit is switched to a refrigerant circuit in which the inside evaporator 18 and the chiller 20 are connected in parallel to the refrigerant flow.

In the low-temperature side heat medium circuit 40 in the cooling and air-cooling mode, the control device 60 controls the operation of the low-temperature side pump 41 similarly to the cooling and air-cooling mode of the first embodiment. The control device 60 appropriately controls the operations of other control target devices.

Therefore, in the heat pump cycle 10*a* in the cooling and air-cooling mode, a vapor compression refrigeration cycle is configured in which the inside condenser 131 and the outside heat exchanger 15 function as condensers, and the inside evaporator 18 and the chiller 20 function as evaporators.

In the low-temperature side heat medium circuit 40 in the cooling and air-cooling mode, the battery 70 is cooled as in the first embodiment.

In the interior air conditioning unit 50 in the cooling and air-cooling mode, the ventilation air with a regulated temperature is blown into the vehicle cabin, so that the air in the vehicle cabin is cooled, as in the first embodiment.

(b-1) Single Series Dehumidification and Air-Heating Mode

In the heat pump cycle 10*a* in the single series dehumidification and air-heating mode, the control device 60 brings the air-heating expansion valve 14*a* into the throttled state, brings the air-cooling expansion valve 14*b* into the throttled state, brings the cooling expansion valve 14*c* into the fully closed state, and brings the bypass-side flow-rate regulating valve 14*d* into the fully closed state. In addition, the control device 60 closes the air-heating on-off valve 22*b*, closes the first inlet-port side on-off valve 22*c*, and opens the second inlet-port side on-off valve 22*d*.

Therefore, in the heat pump cycle 10*a* in the single series dehumidification and air-heating mode, the refrigerant circuit is switched to a refrigerant circuit in which the refrigerant discharged from the compressor 11 circulates through the inside condenser 131, the air-heating expansion valve 14*a* in the throttled state, the outside heat exchanger 15, the receiver 24, the air-cooling expansion valve 14*b* in the throttled state, the inside evaporator 18, and the suction port of the compressor 11 in this order. The control device 60 appropriately controls the operations of other control target devices.

Therefore, in the heat pump cycle 10*a* in the single series dehumidification and air-heating mode, a vapor compression refrigeration cycle is configured in which the inside condenser 131 and the outside heat exchanger 15 function as condensers, and the inside evaporator 18 function as an evaporator.

In the interior air conditioning unit 50 in the single air-cooling mode, the ventilation air whose temperature and humidity have been regulated is blown into the vehicle cabin, so that the air in the vehicle cabin is dehumidified and heated, as in the first embodiment. Since the heat pump cycle 10*a* includes the receiver 24, the single series dehumidification and air-heating mode is performed in the temperature range in which the saturation temperature of the refrigerant in the outside heat exchanger 15 is higher than the outside air temperature Tam.

(b-2) Cooling Series Dehumidification and Air-Heating Mode

In the heat pump cycle 10*a* in the cooling series dehumidification and air-heating mode, the control device 60 brings the cooling expansion valve 14*c* into the throttled state as compared with the single series dehumidification and air-heating mode.

Therefore, in the heat pump cycle 10*a* in the cooling series dehumidification and air-heating mode, the refrigerant discharged from the compressor 11 circulates similarly to the single series dehumidification and air-heating mode. At the same time, the refrigerant circuit is switched to a refrigerant circuit in which the refrigerant discharged from the compressor 11 circulates through the inside condenser 131, the air-heating expansion valve 14*a* in the fully open state, the outside heat exchanger 15, the receiver 24, the cooling expansion valve 14*c* in the throttled state, the chiller 20, and the suction port of the compressor 11 in this order. That is, the refrigerant circuit is switched to a refrigerant circuit in which the inside evaporator 18 and the chiller 20 are connected in parallel to the refrigerant flow.

In the low-temperature side heat medium circuit 40 in the cooling series dehumidification and air-heating mode, the control device 60 operates the low-temperature side pump 41 as in the cooling and air-cooling mode. The control device 60 appropriately controls the operations of other control target devices.

Therefore, in the heat pump cycle 10*a* in the cooling series dehumidification and air-heating mode, a vapor compression refrigeration cycle is configured in which the inside condenser 131 and the outside heat exchanger 15 function as condensers, and the inside evaporator 18 and the chiller 20 function as evaporators.

In the low-temperature side heat medium circuit 40 in the cooling series dehumidification and air-heating mode, the battery 70 is cooled as in the first embodiment.

In the interior air conditioning unit 50 in the cooling series dehumidification and air-heating mode, the ventilation air whose temperature and humidity have been regulated is blown into the vehicle cabin, so that the air in the vehicle cabin is dehumidified and heated, as in the first embodiment. Since the heat pump cycle 10*a* includes the receiver 24, the cooling series dehumidification and air-heating mode is performed in the temperature range in which the saturation temperature of the refrigerant in the outside heat exchanger 15 is higher than the outside air temperature Tam.

(c-1) Single Outside-Air Heat-Absorption and Air-Heating Mode

In the heat pump cycle 10*a* in the single outside-air heat-absorption and air-heating mode, the control device 60 brings the air-heating expansion valve 14*a* into the throttled state, brings the air-cooling expansion valve 14*b* into the fully closed state, brings the cooling expansion valve 14*c* into the fully closed state, and brings the bypass-side flow-rate regulating valve 14*d* into the fully closed state. In addition, the control device 60 opens the air-heating on-off valve 22*b*, opens the first inlet-port side on-off valve 22*c*, and closes the second inlet-port side on-off valve 22*d*.

Therefore, in the heat pump cycle 10*a* in the single outside-air heat-absorption and air-heating mode, the refrigerant circuit is switched to a refrigerant circuit in which the refrigerant discharged from the compressor 11 circulates through the inside condenser 131, the receiver 24, the air-heating expansion valve 14*a* in the throttled state, the outside heat exchanger 15, the air-heating passage 21*b*, and the suction port of the compressor 11 in this order. The control device 60 appropriately controls the operations of other control target devices.

Therefore, in the heat pump cycle 10*a* in the single outside-air heat-absorption and air-heating mode, a vapor compression refrigeration cycle is configured in which the inside condenser 131 functions as a condenser and the outside heat exchanger 15 functions as an evaporator.

In the interior air conditioning unit 50 in the single outside-air heat-absorption and air-heating mode, as in the first embodiment, the ventilation air with a regulated temperature is blown into the vehicle cabin, so that the air in the vehicle cabin is heated.

(c-2) Cooling Outside-Air Heat-Absorption and Air-Heating Mode

In the heat pump cycle 10*a* in the cooling outside-air heat-absorption and air-heating mode, the control device 60 brings the cooling expansion valve 14*c* into the throttled state as compared with the single outside-air heat-absorption and air-heating mode.

Therefore, in the heat pump cycle 10*a* in the cooling outside-air heat-absorption and air-heating mode, the refrigerant discharged from the compressor 11 circulates similarly to the single outside-air heat-absorption and air-heating mode. At the same time, the refrigerant circuit is switched to a refrigerant circuit in which the refrigerant discharged from the compressor 11 circulates through the inside condenser 131, the receiver 24, the cooling expansion valve 14*c* in the throttled state, the chiller 20, and the suction port of the compressor 11 in this order. That is, the refrigerant circuit is switched to a refrigerant circuit in which the outside heat exchanger 15 and the chiller 20 are connected in parallel to the refrigerant flow.

In the low-temperature side heat medium circuit 40 in the cooling outside-air heat-absorption and air-heating mode, the control device 60 operates the low-temperature side pump 41 as in the cooling and air-cooling mode. The control device 60 appropriately controls the operations of other control target devices.

Therefore, in the heat pump cycle 10*a* in the cooling outside-air heat-absorption and air-heating mode, a vapor compression refrigeration cycle is configured in which the inside condenser 131 functions as a condenser, and the outside heat exchanger 15 and the chiller 20 function as evaporators.

In the low-temperature side heat medium circuit 40 in the cooling outside-air heat-absorption and air-heating mode, the battery 70 is cooled as in the first embodiment.

In the interior air conditioning unit 50 in the cooling outside-air heat-absorption and air-heating mode, as in the first embodiment, the ventilation air with a regulated temperature is blown into the vehicle cabin, so that the air in the vehicle cabin is heated.

(d-1) Single Hot-Gas Air-Heating Mode

In the heat pump cycle 10*a* in the single hot-gas air-heating mode, the control device 60 brings the air-heating expansion valve 14*a* into the fully closed state, brings the air-cooling expansion valve 14*b* into the fully closed state, brings the cooling expansion valve 14*c* into the throttled state, and brings the bypass-side flow-rate regulating valve 14*d* into the throttled state. In addition, the control device 60 closes the air-heating on-off valve 22*b*, opens the first inlet-port side on-off valve 22*c*, and closes the second inlet-port side on-off valve 22*d*.

Therefore, in the heat pump cycle 10*a* in the single hot-gas air-heating mode, the refrigerant discharged from the compressor 11 circulates through the first three-way joint 12*a*, the inside condenser 131, the receiver 24, the cooling expansion valve 14*c* in the throttled state, the sixth three-way joint 12*f*, the chiller 20, and the suction port of the compressor 11 in this order. At the same time, the refrigerant circuit is switched to a refrigerant circuit in which the refrigerant discharged from the compressor 11 circulates through the first three-way joint 12*a*, the bypass-side flow-rate regulating valve 14*d* in the throttled state, which is disposed in the bypass passage 21*c*, the sixth three-way joint 12*f*, the chiller 20, and the suction port of the compressor 11 in this order.

The control device 60 also controls the throttle opening of the cooling expansion valve 14*c* in a manner that the degree of superheating SH of the suction refrigerant approaches the reference degree of superheating KSH. The control device 60 appropriately controls the operations of other control target devices as in the first embodiment. Therefore, in the hot-gas air-heating mode, the cooling expansion valve 14*c* serves as the heating-unit side decompression unit.

As a result, in the single hot-gas air-heating mode of the present embodiment, even when the outside air temperature Tam is extremely low, the heat generated by the workload of the compressor 11 can be effectively used to heat the ventilation air, and the air in the vehicle cabin can be heated, as in the first embodiment.

(d-2) Cooling Hot-Gas Air-Heating Mode

In the cooling hot-gas air-heating mode, the control device 60 operates the low-temperature side pump 41 so as to exhibit the predetermined reference pumping performance, as compared with the single hot-gas air-heating mode. The other operations are similar to those in the single hot-gas air-heating mode.

Therefore, in the cooling hot-gas air-heating mode, the heat generated by the workload of the compressor 11 can be effectively used to heat the ventilation air, and the air in the vehicle cabin can be heated. The battery 70 can be cooled as in the first embodiment.

(e-1) Single Hot-Gas Dehumidification and Air-Heating Mode

In the heat pump cycle 10*a* in the single hot-gas dehumidification and air-heating mode, the control device 60 brings the air-heating expansion valve 14*a* into the fully closed state, brings the air-cooling expansion valve 14*b* into the throttled state, brings the cooling expansion valve 14*c* into the throttled state, and brings the bypass-side flow-rate regulating valve 14*d* into the throttled state. In addition, the control device 60 closes the air-heating on-off valve 22*b*, opens the first inlet-port side on-off valve 22*c*, and closes the second inlet-port side on-off valve 22*d*.

Therefore, in the heat pump cycle 10*a* in the single hot-gas dehumidification and air-heating mode, the refrigerant discharged from the compressor 11 circulates similarly to the cooling hot-gas air-heating mode. At the same time, the refrigerant circuit is switched to a refrigerant circuit in which the refrigerant discharged from the compressor 11 circulates through the first three-way joint 12*a*, the chiller 20, the receiver 24, the air-cooling expansion valve 14*b* in the throttled state, the inside evaporator 18, and the suction port of the compressor 11 in this order.

The control device 60 also controls the throttle opening of the cooling expansion valve 14*c* in a manner that the degree of superheating SH of the suction refrigerant approaches the reference degree of superheating KSH. The control device 60 appropriately controls the operations of other control target devices as in the first embodiment. Therefore, in the hot-gas dehumidification and air-heating mode, the cooling expansion valve 14*c* serves as the heating-unit side decompression unit, as in the first embodiment.

As a result, in the single hot-gas dehumidification and air-heating mode of the present embodiment, the ventilation air is heated with higher heating performance than in the series dehumidification and air-heating mode, and the air in the vehicle cabin can be dehumidified and heated, as in the first embodiment.

(e-2) Cooling Hot-Gas Dehumidification and Air-Heating Mode

In the cooling hot-gas dehumidification and air-heating mode, the control device 60 operates the low-temperature side pump 41 so as to exhibit the predetermined reference pumping performance, as compared with the single hot-gas dehumidification and air-heating mode. The other operations are similar to those in the single hot-gas dehumidification and air-heating mode.

Therefore, in the cooling hot-gas dehumidification and air-heating mode, the ventilation air is heated with higher heating performance than in the series dehumidification and air-heating mode, and the air in the vehicle cabin can be dehumidified and heated, as in the single hot-gas dehumidification and air-heating mode. The battery 70 can be cooled as in the first embodiment.

(f-1) Single Hot-Gas Series Dehumidification and Air-Heating Mode

In the heat pump cycle 10*a* in the single hot-gas series dehumidification and air-heating mode, the control device 60 brings the air-heating expansion valve 14*a* into the throttled state, brings the air-cooling expansion valve 14*b* into the throttled state, brings the cooling expansion valve 14*c* into the throttled state, and brings the bypass-side flow-rate regulating valve 14*d* into the throttled state. In addition, the control device 60 closes the air-heating on-off valve 22*b*, closes the first inlet-port side on-off valve 22*c*, and opens the second inlet-port side on-off valve 22*d*.

Therefore, in the heat pump cycle 10*a* in the single hot-gas series dehumidification and air-heating mode, the refrigerant discharged from the compressor 11 circulates similarly to the cooling series dehumidification and air-heating mode. At the same time, the refrigerant circuit is switched to a refrigerant circuit in which the refrigerant discharged from the compressor 11 circulates through the first three-way joint 12*a*, the bypass-side flow-rate regulating valve 14*d* in the throttled state, which is disposed in the bypass passage 21*c*, the sixth three-way joint 12*f*, and the suction port of the compressor 11 in this order.

The control device 60 also controls the throttle opening of the cooling expansion valve 14*c* in a manner that the degree of superheating SH of the suction refrigerant approaches the reference degree of superheating KSH. The control device 60 appropriately controls the operations of other control target devices as in the first embodiment. Therefore, in the hot-gas series dehumidification and air-heating mode, the air-heating expansion valve 14*a* and the cooling expansion valve 14*c* serve as the heating-unit side decompression unit, as in the first embodiment.

As a result, in the single hot-gas series dehumidification and air-heating mode of the present embodiment, the ventilation air is heated with higher heating performance than in the series dehumidification and air-heating mode, and the air in the vehicle cabin can be dehumidified and heated, as in the first embodiment.

(f-2) Cooling Hot-Gas Series Dehumidification and Air-Heating Mode

In the cooling hot-gas series dehumidification and air-heating mode, the control device 60 operates the low-temperature side pump 41 so as to exhibit the predetermined reference pumping performance, as compared with the single hot-gas series dehumidification and air-heating mode. The other operations are similar to those in the single hot-gas series dehumidification and air-heating mode.

Therefore, in the cooling hot-gas series dehumidification and air-heating mode, the ventilation air is heated with higher heating performance than in the series dehumidification and air-heating mode, and the air in the vehicle cabin can be dehumidified and heated, as in the single hot-gas series dehumidification and air-heating mode. The battery 70 can be cooled similarly to the cooling hot-gas series dehumidification and air-heating mode of the first embodiment. Furthermore, the compressor 11 can be protected by executing the upper limit opening control and the opening increase control.

As described above, the vehicle air conditioner 1*a* of the present embodiment can also achieve effects similar to those of the first embodiment. That is, by switching the operation mode, comfortable air conditioning in the vehicle cabin and appropriate temperature regulation of the battery 70, which is an in-vehicle device, can be performed.

Furthermore, since the suction-side flow path length L1 is equal to or longer than the relaxation distance Lv, effects similar to those of the first embodiment can be obtained. That is, even in the heat pump cycle device in which refrigerants with different enthalpies are mixed and sucked into the compressor, the compressor 11 can be protected without deteriorating productivity.

The present disclosure is not limited to the embodiments described above, and can be variously modified as follows without departing from the gist of the present disclosure.

In the above embodiments, the example in which the heat pump cycle device according to the present disclosure is applied to an air conditioner has been described, but the application target of the heat pump cycle device is not limited to the air conditioner. For example, it may be applied to a water heater that heats domestic water or the like as a heating object. The heating object is not limited to a fluid. For example, the heating object may be a heat generating device in which a heat medium passage for circulating a high-temperature side heat medium for warm-up or the like is formed.

The configuration of the heat pump cycle device according to the present disclosure is not limited to the configurations disclosed in the embodiments described above.

In the above embodiments, the example in which the sixth three-way joint 12*f* formed in such a manner that the joining angle θv is about 90° is used as the joining portion has been described, but the joining angle θv is not limited. The joining angle θv may be set to a value that makes it possible to reduce the average flow velocity Uv at the junction MX without unnecessarily increasing the pressure loss generated in the refrigerant flowing through the sixth three-way joint 12*f*. Specifically, the angle may be set to be equal to or larger than 45° and be equal to or less than 135°.

In the above embodiments, the example in which the length of the suction-side passage 21*d* from the outlet port of the sixth three-way joint 12*f* to the suction port of the compressor 11 is defined as the suction-side flow path length L1 has been described. Alternatively, the length of the refrigerant passage from the junction MX to the suction port of the compressor 11 may be defined as the suction-side flow path length L1.

In the above embodiments, the example in which the second check valve 16*b* is used has been described, but an evaporation pressure regulating valve may be used instead of the second check valve 16*b*. The evaporation pressure regulating valve is a variable throttle mechanism that maintains a refrigerant evaporating temperature in the inside evaporator 18 at a predetermined temperature (for example, a temperature at which the inside evaporator 18 can be suppressed) or higher.

As the evaporation pressure regulating valve, a variable throttle mechanism including a mechanical mechanism that increases the valve opening as the pressure of the refrigerant on the refrigerant outlet-port side of the inside evaporator 18 increases may be used. As the evaporation pressure regulating valve, a variable throttle mechanism including an electric mechanism similar to that of the air-heating expansion valve 14*a* or the like may be used.

In the fourth embodiment described above, the example in which the accumulator 23 is disposed in the suction-side passage 21*d* has been described, but it is not limited thereto. A muffler may be disposed in the suction-side passage 21*d* as long as the effect of reducing the average flow velocity Uv at the junction MX can be obtained. The muffler forms a buffer space for reducing the pressure pulsation of the suction refrigerant.

A subcooling expansion valve that decompresses the refrigerant flowing into the receiver 24 may be disposed in the heat pump cycle 10*a* of the fifth embodiment described above. More specifically, as the subcooling expansion valve, a fixed throttle may be used, or a variable throttle mechanism may be used. The subcooling expansion valve is desirably disposed in a refrigerant flow path from the outlet port of the seventh three-way joint 12*g* to the inlet port of the receiver 24.

According to this, the degree of subcooling of the refrigerant flowing out of the inside condenser 131 can be increased to increase the refrigerant pressure (that is, the discharge refrigerant pressure Pd) in the inside condenser 131. As a result, the heating performance of the ventilation air in the inside condenser 131 can be improved.

In the fifth embodiment described above, the example in which the sixth three-way joint 12*f*, which is a joining portion, is disposed in the refrigerant flow path from the outlet port of the cooling expansion valve 14*c* to the inlet port of the refrigerant passage in the chiller 20 has been described, but it is not limited thereto. In the heat pump cycle 10*a*, the sixth three-way joint 12*f* may be disposed in the refrigerant flow path from the outlet of the refrigerant passage in the chiller 20 to the suction port of the compressor 11.

Furthermore, the control sensor group connected to the input side of the control device 60 is not limited to the detection unit disclosed in the embodiments described above. Various detection units may be added, as necessary.

In the above embodiments, the example of using R1234yf as the refrigerant of the heat pump cycles 10 and 10*a* has been described, but it is not limited thereto. For example, R134a, R600a, R410A, R404A, R32, R407C, and the like may be used. Alternatively, a mixed refrigerant obtained by mixing a plurality of types of these refrigerants or the like may be used. Furthermore, carbon dioxide may be used as a refrigerant, and a supercritical refrigeration cycle in which the high-pressure side refrigerant pressure is equal to or higher than the critical pressure of the refrigerant may be configured.

The example of using an ethylene glycol aqueous solution as the low-temperature side heat medium and the high-temperature side heat medium of the embodiments described above has been described, but it is not limited thereto. As the high-temperature side heat medium and the low-temperature side heat medium, for example, a solution containing dimethylpolysiloxan, nanofluid, or the like, an antifreeze liquid, an aqueous liquid refrigerant containing alcohol or the like, or a liquid medium containing oil or the like may be used.

The control mode of the heat pump cycle device according to the present disclosure is not limited to the control modes disclosed in the embodiments described above.

In the above embodiments, the vehicle air conditioners 1 and 1*a* capable of performing various operation modes have been described, but the heat pump cycle device according to the present disclosure does not need to be capable of performing all the operation modes described above.

The heat pump cycle device according to the present disclosure can obtain effects similar to those of the above embodiments as long as the heat pump cycle device can perform at least one of the hot-gas air-heating mode, the hot-gas defrosting and air-heating mode, or the hot-gas series dehumidification and air-heating mode. That is, even in the heat pump cycle device in which refrigerants with different enthalpies are mixed and sucked into the compressor, the compressor 11 can be protected without deteriorating productivity.

Furthermore, it may be possible to perform other operation modes. For example, it may be possible to perform a device cooling mode in which only the battery 70 is cooled without performing air conditioning the vehicle cabin. Specifically, when the device cooling mode is performed, the control device 60 switches the refrigerant circuit of the heat pump cycle 10 in the same manner as in the cooling and air-cooling mode to bring the air-cooling expansion valve 14*b* into the fully closed state. In addition, the control device 60 may stop the inside blower 52.

Furthermore, for example, when the battery 70 is at an extremely low temperature, it is possible to perform a warm-up hot-gas air-heating mode of warming up the battery 70. Specifically, when the battery 70 is at an extremely low temperature, the control device 60 may warm up the battery 70 by performing operation similar to that in the cooling hot-gas air-heating mode.

In addition, the control mode of the control device 60 in the hot-gas air-heating mode is not limited to the examples disclosed in the above embodiments.

For example, the control device 60 may control the refrigerant discharge performance of the compressor 11 in a manner that the discharge refrigerant pressure Pd approaches the target high pressure PDO. In this case, the operation of the bypass-side flow-rate regulating valve 14*d* may be controlled in a manner that the suction refrigerant pressure Ps approaches the first target low pressure PSO1. The operation of the cooling expansion valve 14*c* may be controlled in a manner that the degree of superheating SH of the suction refrigerant approaches the reference degree of superheating KSH.

For example, the control device 60 may control the throttle opening of the cooling expansion valve 14*c* in a manner that the discharge refrigerant pressure Pd approaches the target high pressure PDO. In this case, the control device 60 may control the refrigerant discharge performance of the compressor 11 in a manner that the suction refrigerant pressure Ps approaches the first target low pressure PSO1. The operation of the bypass-side flow-rate regulating valve 14*d* may be controlled in a manner that the degree of superheating SH of the suction refrigerant approaches the reference degree of superheating KSH.

That is, in the hot-gas air-heating mode, the control device 60 may control the operation of at least one of the compressor 11, the heating-unit side decompression unit, or the bypass-side flow-rate regulating unit in a manner that the degree of superheating SH of the suction refrigerant approaches the reference degree of superheating KSH. The same applies to the hot-gas dehumidification and air-heating mode and the hot-gas series dehumidification and air-heating mode.

In the hot-gas air-heating mode, the control device 60 may control the operation of at least one of the compressor 11, the heating-unit side decompression unit, or the bypass-side flow-rate regulating unit in a manner that the dryness Rx of the suction refrigerant approaches the reference dryness KRx.

More specifically, the heat pump cycle device includes a dryness detection unit for detecting or estimating the dryness Rx of the suction refrigerant. The length of the flow path from the outlet port of the sixth three-way joint 12*f* to the attachment portion of the dryness detection unit is set to be equal to or longer than the relaxation distance Lv. The control device 60 may control the operation of at least one of the compressor 11, the heating-unit side decompression unit, or the bypass-side flow-rate regulating unit in a manner that the dryness Rx of the suction refrigerant approaches the reference dryness KRx.

At this time, the reference dryness KRx may be set in a manner that the suction refrigerant is a gas-liquid two-phase refrigerant appropriately containing a liquid-phase refrigerant in which refrigerant oil is dissolved.

As a result, the refrigerant to be detected by the dryness detection unit can be made homogeneous. The control device 60 can accurately determine or estimate the dryness Rx of the suction refrigerant and appropriately control the operations of various control target devices.

Furthermore, the control mode in which the dryness Rx of the suction refrigerant is controlled to approach the reference dryness KRx is effective in that a decrease in the dryness of the suction refrigerant due to liquid level loss and an insufficient return amount of the refrigerant oil to the compressor 11 can be prevented in the heat pump cycle device including the accumulator 23 as in the third embodiment.

The means disclosed in the individual embodiments may be appropriately combined within a feasible range.

For example, the inside condenser 131 described in the fifth embodiment may be used as the heating unit of the vehicle air conditioner 1 of the first to fourth embodiments. Similarly, the water-refrigerant heat exchanger 13 and the high-temperature side heat medium circuit 30 described in the first embodiment may be used as the heating unit of the vehicle air conditioner 1*a* of the fifth embodiment.

In the vehicle air conditioner 1*a* of the fifth embodiment, the example in which the sixth three-way joint 12*f*, which is a joining portion, is disposed in the refrigerant flow path from the outlet port of the cooling expansion valve 14*c* to the inlet port of the refrigerant passage in the chiller 20 has been described, but the sixth three-way joint may be disposed as in the first embodiment. That is, in the vehicle air conditioner 1*a* of the fifth embodiment, the sixth three-way joint 12*f* as the joining portion may be disposed in the refrigerant flow path from the refrigerant outlet port of the chiller 20 to the suction port of the compressor 11.

Although the present disclosure has been described in accordance with examples, it is understood that the present disclosure is not limited to the examples and structures. The present disclosure also includes various modifications and modifications within an equivalent range. In addition, various combinations and modes, and other combinations and modes including only one element, more elements, or less elements are also within the scope and idea of the present disclosure.

What is claimed is:

1. A heat pump cycle device comprising:

a compressor configured to compress and discharge a refrigerant;

a branch portion configured to branch a flow of the refrigerant discharged from the compressor;

a heating unit configured to heat a heating object using one refrigerant branched at the branch portion as a heat source;

a decompression unit configured to decompress the refrigerant flowing out of the heating unit;

a bypass passage through which an another refrigerant branched at the branch portion flows;

a regulating unit configured to regulate a flow rate of the refrigerant flowing through the bypass passage; and a joining portion configured to join a flow of a heating-unit side refrigerant flowing out of the decompression unit and a flow of a bypass-side refrigerant flowing out of the regulating unit and to cause a joined refrigerant to flow to a suction port of the compressor, wherein a length of a suction-side flow path from an outlet port of the joining portion to the suction port of the compressor is defined as a suction-side flow path length L1, and the suction-side flow path length L1 is equal to or longer than a relaxation distance Lv, the relaxation distance Lv is defined by following Formula 1, $$Lv = \frac{\rho L \times dp^2}{18\ \mu g} \times Uv \quad \text{(Formula 1)}$$

in the Formula 1, ρL is a density of droplets that are particles of a liquid-phase refrigerant contained in the refrigerant at a junction MX of the heating-unit side refrigerant and the bypass-side refrigerant in the joining portion, dp is an average diameter of the droplets, μg is a viscosity of a gas-phase refrigerant contained in the refrigerant at the junction MX, and Uv is an average flow velocity of the droplets and the gas-phase refrigerant at the junction MX.

2. The heat pump cycle device according to claim 1, further comprising a refrigerant temperature detector configured to detect a temperature of a suction refrigerant to be sucked into the compressor, wherein a length of a flow path from the outlet port of the joining portion to an attachment portion of the refrigerant temperature detector is defined as a detector flow path length L2, and the detector flow path length L2 is equal to or longer than the relaxation distance Lv.

3. The heat pump cycle device according to claim 1, further comprising a low-pressure side gas-liquid separating unit that is disposed in the suction-side flow path and to separate the refrigerant flowing through the suction-side flow path into gas and liquid.

4. The heat pump cycle device according to claim 1, further comprising a heat exchanger that is disposed in the suction-side flow path to exchange heat between the refrigerant and a heat medium.

5. The heat pump cycle device according to claim 1, wherein a refrigerant passage inside the joining portion is configured to cause a flow direction of the heating-unit side refrigerant immediately before joining and a flow direction of the bypass-side refrigerant immediately before joining to cross each other.

6. A heat pump cycle device comprising:

a compressor configured to compress and discharge a refrigerant;

a branch joint configured to branch a flow of the refrigerant discharged from the compressor into a first stream and a second stream;

a heater configured to heat a heating object using one refrigerant of the first stream branched at the branch portion as a heat source;

a decompression valve configured to decompress the refrigerant flowing out of the heater;

a bypass passage through which an another refrigerant of the second stream branched at the branch joint flows;

a regulating valve configured to regulate a flow rate of the refrigerant flowing through the bypass passage; and a joining joint configured to mix a flow of the refrigerant flowing out of the decompression valve and a flow of the refrigerant flowing out of the regulating valve at a junction, and to cause a mixed refrigerant to flow to a suction port of the compressor, wherein a length of a suction-side flow path from an outlet port of the joining joint to the suction port of the compressor is defined as a first flow path length L1, and the first flow path length L1 is equal to or longer than a predetermined distance Lv that is set to cause the refrigerant mixed in the joining joint into a homogeneous state in which a temperature and a velocity of the mixed refrigerant are reached in an equilibrium state.

7. The heat pump cycle device according to claim 6, further comprising a refrigerant temperature detector configured to detect a temperature of a suction refrigerant to be sucked into the compressor, wherein a length of a flow path from the outlet port of the joining joint to an attachment portion of the refrigerant temperature detector is defined as a second flow path length L2, and the second flow path length L2 is equal to or longer than the predetermined distance Lv.

* * * * *